US011834253B2

(12) United States Patent
Rogers et al.

(10) Patent No.: US 11,834,253 B2
(45) **Date of Patent: *Dec. 5, 2023**

(54) INSULATING DEVICE

(71) Applicant: YETI Coolers, LLC, Austin, TX (US)

(72) Inventors: Kyle Edward Rogers, Austin, TX (US); Jeffrey Charles Munie, Austin, TX (US); John Loudenslager, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/067,560

(22) Filed: Dec. 16, 2022

(65) Prior Publication Data

US 2023/0118288 A1 Apr. 20, 2023

Related U.S. Application Data

(63) Continuation of application No. 17/563,821, filed on Dec. 28, 2021, now Pat. No. 11,565,872, which is a (Continued)

(51) Int. Cl.

| | |
|---|---|
| ***B65D 81/38*** | (2006.01) |
| ***A45C 11/20*** | (2006.01) |
| ***A45C 13/10*** | (2006.01) |

(52) U.S. Cl.

CPC ..... *B65D 81/3897* (2013.01); *A45C 11/20* (2013.01); *A45C 13/1069* (2013.01); *B65D 81/389* (2013.01)

(58) Field of Classification Search

CPC .... B65D 81/18; B65D 81/38; B65D 81/3818; B65D 81/3823; B65D 81/389; (Continued)

(56) References Cited

U.S. PATENT DOCUMENTS

| | | | |
|---|---|---|---|
| 210,994 | A | 12/1878 | Carnagy |
| 430,944 | A | 6/1890 | Hammed |

(Continued)

FOREIGN PATENT DOCUMENTS

| | | | |
|---|---|---|---|
| AU | 201614228 | S | 8/2016 |
| AU | 201614229 | S | 8/2016 |

(Continued)

OTHER PUBLICATIONS amazon.com, "E-Manis Insulated Lunch Bag Adult Lunch Box Collapsible Multi-Layers Thermal Insulated Oxford Lunch Tote Cooler Bag for Men, women (grey)," visited May 7, 2019 at <https://www.amazon.com/MANIS-Insulated-Portable-Cooler-School/dp/B07BMT6948/ref=sr_1_23?keywords=soft+sided+cooler+lunch+box&qid=1557170800&s=home-garden&sr=1-23>.

(Continued)

*Primary Examiner* — Chun Hoi Cheung
*Assistant Examiner* — Brijesh V. Patel
(74) *Attorney, Agent, or Firm* — Banner & Witcoff, Ltd.

(57) ABSTRACT

An insulating device can include a body assembly and a lid assembly where an insulating layer is connected to both the body assembly and the lid assembly. An aperture with a closure is formed between the body assembly and lid assembly to form a storage compartment. An insulating tab may be formed from a portion of the insulating layer and an inner liner of the body assembly to help insulate the closure region. In addition, a first magnetic element may be secured within the insulating tab that may engage a second magnetic element secured within the lid assembly.

18 Claims, 6 Drawing Sheets

Related U.S. Application Data continuation of application No. 16/685,124, filed on Nov. 15, 2019, now Pat. No. 11,242,189.

(58) Field of Classification Search

CPC ..... B65D 81/3897; B65D 81/2023; B65D 81/203; B65D 81/2038; B65D 33/24; B65D 85/07; B65D 85/10564; B65D 2313/04; A45C 11/20; A45C 13/008; A45C 13/02; A45C 13/10; A45C 13/103; A45C 13/1069; A45C 13/26; A45C 13/30; A45C 3/00; A45C 3/001; A45C 7/0077; A45C 2200/20; A45C 2013/026; F25D 3/08; F25D 5/02; F25D 31/002; F25D 2303/081; F25D 2303/0821–0822; F25D 2303/0843; F25D 2331/801; F25D 2331/804; F25D 2400/12; F25D 2323/062; A45F 3/04; A45F 3/06

USPC ..... 220/592.01, 592.16, 592.2, 592.21, 220/592.24–592.25, 739, 495.03, 660, 220/212, 230, 23.83, 4.01; 62/457.1–457.2, 457.7, 457.9, 440; 383/64, 109–110, 119, 211, 24, 4, 97, 17, 383/25, 43, 59, 61.1; D3/289, 285, 287, D3/279, 301

See application file for complete search history.

(56) References Cited

U.S. PATENT DOCUMENTS 1,512,549 A 10/1924 Labadie et al.
1,587,655 A 6/1926 Kidwell
1,895,278 A 1/1933 Crawford
1,949,677 A 3/1934 Crawford
2,119,621 A 6/1938 Ferrone
2,241,612 A 5/1941 Norris
2,253,598 A 8/1941 Africa
2,289,254 A 7/1942 Eagles
2,429,538 A 10/1947 Wood
2,522,381 A 9/1950 Kramer
2,556,066 A 6/1951 Cline
2,570,300 A 10/1951 Acton
2,575,191 A 11/1951 Seipp
2,575,893 A 11/1951 Seaman
2,623,566 A 12/1952 Kibler
2,633,223 A 3/1953 Zeamer
2,651,485 A 9/1953 Schutz
2,661,785 A 12/1953 Daust
2,685,385 A 8/1954 Kuss
2,808,093 A 10/1957 Gilman
2,883,041 A 4/1959 Pfeifer et al.
2,954,891 A 10/1960 Imber
2,960,136 A 11/1960 Ziff
3,031,121 A 4/1962 Chase
3,035,733 A 5/1962 Knapp
3,066,846 A 12/1962 Domigan
3,121,452 A 2/1964 Hyman
3,157,303 A 11/1964 Siegel
3,203,517 A 8/1965 Stein
3,292,277 A 12/1966 Teschon
3,454,197 A 7/1969 Thompson
3,455,359 A 7/1969 Schweizer
3,743,522 A 7/1973 Nagasawa et al.
3,801,425 A 4/1974 Cook
3,814,288 A 6/1974 Westrich
3,834,044 A 9/1974 McAusland et al.
3,903,944 A * 9/1975 Montgomery ..... A45C 3/00 224/438
3,905,511 A 9/1975 Groendal
4,024,731 A 5/1977 Branscum
4,117,874 A 10/1978 Berenguer
4,125,212 A 11/1978 Courchesne
4,127,155 A 11/1978 Hydom
4,143,695 A 3/1979 Hoehn
4,180,111 A 12/1979 Davis
4,194,627 A 3/1980 Christensen
4,196,817 A 4/1980 Moser
4,197,890 A 4/1980 Simko
4,210,186 A 7/1980 Belenson
4,211,091 A 7/1980 Campbell
4,211,267 A 7/1980 Skovgaard
4,248,366 A 2/1981 Christiansen
D265,948 S 8/1982 Stark
4,344,303 A 8/1982 Kelly, Jr.
4,372,453 A 2/1983 Branscum
4,375,828 A 3/1983 Biddison
4,378,866 A 4/1983 Pelavin
D268,879 S 5/1983 Outcalt
4,399,668 A 8/1983 Williamson
4,468,933 A 9/1984 Christopher
4,484,682 A 11/1984 Crow
4,513,895 A 4/1985 Leslie
4,515,421 A 5/1985 Steffes
4,521,910 A 6/1985 Keppel et al.
4,524,493 A 6/1985 Inamura
4,537,313 A 8/1985 Workman
4,541,540 A 9/1985 Gretz et al.
D281,122 S 10/1985 Bomes et al.
D281,546 S 12/1985 Bradshaw
D281,646 S 12/1985 Bomes et al.
D282,602 S 2/1986 Allen
4,571,338 A 2/1986 Okonogi et al.
4,592,091 A 5/1986 Italic
4,595,101 A 6/1986 Rivera
4,596,370 A 6/1986 Adkins
D284,620 S 7/1986 Calton
4,598,746 A 7/1986 Rabinowitz
4,610,286 A 9/1986 Cyr
4,637,063 A 1/1987 Sullivan et al.
4,648,121 A * 3/1987 Lowe ..... A45F 3/04 224/651
D289,128 S 4/1987 Bradshaw
4,673,117 A 6/1987 Calton
4,679,242 A 7/1987 Brockhaus
4,708,254 A 11/1987 Byrns
4,746,028 A 5/1988 Bagg
4,759,077 A 7/1988 Leslie
4,765,476 A 8/1988 Lee
4,796,785 A 1/1989 Merritt
4,796,937 A 1/1989 Andrea
4,802,344 A 2/1989 Livingston et al.
4,802,602 A 2/1989 Evans et al.
4,805,776 A 2/1989 Namgyal et al.
4,812,054 A 3/1989 Kirkendall
4,815,999 A 3/1989 Ayon et al.
4,817,769 A 4/1989 Saliba
4,825,514 A 5/1989 Akeno
4,826,060 A 5/1989 Hollingsworth
4,829,603 A 5/1989 Schnoor et al.
4,841,603 A 6/1989 Ragni
4,858,444 A 8/1989 Scott
4,867,214 A 9/1989 Fuller
4,871,069 A 10/1989 Guimont
4,886,183 A 12/1989 Fleming
4,941,603 A 7/1990 Creamer et al.
4,961,522 A 10/1990 Weber
4,966,279 A 10/1990 Pearcy
4,984,906 A 1/1991 Little
4,986,089 A 1/1991 Raab
4,989,418 A 2/1991 Hewlett
5,004,091 A 4/1991 Natho et al.
5,005,679 A 4/1991 Hjelle
5,035,029 A 7/1991 Horita et al.
5,042,664 A 8/1991 Shyr et al.
5,048,734 A 9/1991 Long
5,062,557 A 11/1991 Mahvi et al.
5,095,718 A 3/1992 Ormond et al.
D328,550 S 8/1992 Mogil et al.
5,143,188 A 9/1992 Robinet
5,188,266 A * 2/1993 Loulias ..... B65D 81/3876 383/110
5,190,376 A 3/1993 Book

(56) References Cited

U.S. PATENT DOCUMENTS

| | | | |
|---|---|---|---|
| 5,216,900 | A | 6/1993 | Jones |
| 5,221,016 | A | 6/1993 | Karpal |
| 5,237,838 | A | 8/1993 | Merritt-Munson |
| 5,244,136 | A | 9/1993 | Collaso |
| D339,979 | S | 10/1993 | Wehrley |
| D340,387 | S | 10/1993 | Melk |
| D340,621 | S | 10/1993 | Melk |
| 5,253,395 | A | 10/1993 | Yano |
| D340,840 | S | 11/1993 | Melk |
| 5,269,368 | A | 12/1993 | Schneider et al. |
| D343,992 | S | 2/1994 | Melk |
| 5,295,365 | A | 3/1994 | Redford |
| 5,297,870 | A | 3/1994 | Weldon |
| 5,313,807 | A | 5/1994 | Owen |
| D347,971 | S | 6/1994 | Krugman |
| 5,325,991 | A | 7/1994 | Williams |
| D349,428 | S | 8/1994 | Krugman |
| D351,533 | S | 10/1994 | Lynam, Jr. |
| 5,354,131 | A | 10/1994 | Mogil |
| 5,355,684 | A | 10/1994 | Guice |
| 5,398,848 | A | 3/1995 | Padamsee |
| 5,400,610 | A | 3/1995 | Macedo |
| 5,403,095 | A | 4/1995 | Melk |
| 5,421,172 | A | 6/1995 | Jones |
| 5,447,764 | A | 9/1995 | Langford |
| 5,472,279 | A | 12/1995 | Lin |
| 5,490,396 | A | 2/1996 | Morris |
| 5,509,279 | A | 4/1996 | Brown et al. |
| 5,509,734 | A | 4/1996 | Ausnit |
| D370,599 | S | 6/1996 | Christopher et al. |
| D371,051 | S | 6/1996 | Melk |
| D371,052 | S | 6/1996 | Melk |
| 5,529,217 | A | 6/1996 | Siegel |
| D373,515 | S | 9/1996 | Melk |
| 5,553,759 | A | 9/1996 | McMaster et al. |
| D374,979 | S | 10/1996 | Roberson et al. |
| 5,562,228 | A | 10/1996 | Ericson |
| 5,564,568 | A | 10/1996 | Rankin, Sr. |
| 5,569,401 | A | 10/1996 | Gilliland et al. |
| 5,595,320 | A | 1/1997 | Aghassipour |
| 5,620,069 | A | 4/1997 | Hurwitz |
| D382,771 | S | 8/1997 | Mogil |
| D382,772 | S | 8/1997 | Mogil |
| D383,360 | S | 9/1997 | Melk |
| 5,680,944 | A | 10/1997 | Rueter |
| 5,680,958 | A | 10/1997 | Mann et al. |
| D386,310 | S | 11/1997 | Smith |
| 5,687,874 | A | 11/1997 | Omori et al. |
| D387,249 | S | 12/1997 | Mogil |
| D387,626 | S | 12/1997 | Melk |
| 5,706,969 | A | 1/1998 | Yamada et al. |
| 5,732,867 | A | 3/1998 | Perkins et al. |
| D394,553 | S | 5/1998 | Lin |
| D395,555 | S | 6/1998 | Ursitti |
| 5,758,513 | A | 6/1998 | Smith |
| 5,779,089 | A | 7/1998 | West |
| D397,273 | S | 8/1998 | Collie |
| 5,816,709 | A | 10/1998 | Demus |
| D401,063 | S | 11/1998 | Yamamoto et al. |
| 5,842,571 | A | 12/1998 | Rausch |
| 5,845,514 | A | 12/1998 | Clarke et al. |
| 5,848,734 | A | 12/1998 | Melk |
| 5,857,778 | A | 1/1999 | Ells |
| D409,375 | S | 5/1999 | Santoro et al. |
| D409,376 | S | 5/1999 | Golenz et al. |
| 5,904,230 | A | 5/1999 | Peterson |
| 5,909,821 | A | 6/1999 | Guridi |
| 5,913,448 | A | 6/1999 | Mann et al. |
| 5,915,580 | A | 6/1999 | Melk |
| 5,931,583 | A | 8/1999 | Collie |
| D414,379 | S | 9/1999 | Haberkorn |
| 5,954,253 | A | 9/1999 | Swetish |
| 5,955,948 | A | 9/1999 | Howell |
| 5,964,384 | A | 10/1999 | Young |
| 5,988,468 | A | 11/1999 | Murdoch et al. |
| 5,988,879 | A | 11/1999 | Bredderman et al. |
| 6,019,245 | A | 2/2000 | Foster et al. |
| 6,027,249 | A | 2/2000 | Bielinski |
| 6,029,847 | A | 2/2000 | Mahoney, Jr. et al. |
| 6,048,099 | A | 4/2000 | Muffett et al. |
| D424,417 | S | 5/2000 | Axelsson |
| 6,059,140 | A | 5/2000 | Hicks |
| 6,065,873 | A | 5/2000 | Fowler |
| 6,068,402 | A | 5/2000 | Freese et al. |
| 6,070,718 | A | 6/2000 | Drabwell |
| 6,073,796 | A | 6/2000 | Mogil |
| 6,082,589 | A | 7/2000 | Ash et al. |
| 6,082,896 | A | 7/2000 | Pulli |
| 6,089,038 | A | 7/2000 | Tattam |
| 6,092,266 | A | 7/2000 | Lee |
| 6,092,661 | A | 7/2000 | Mogil |
| 6,105,214 | A | 8/2000 | Press |
| 6,113,268 | A | 9/2000 | Thompson |
| 6,116,045 | A | 9/2000 | Hodosh et al. |
| 6,128,915 | A | 10/2000 | Wagner |
| 6,129,254 | A | 10/2000 | Yu |
| 6,139,188 | A | 10/2000 | Marzano |
| 6,145,715 | A | 11/2000 | Slonim |
| 6,149,305 | A | 11/2000 | Fier |
| D437,110 | S | 2/2001 | Ivarson et al. |
| 6,193,034 | B1 | 2/2001 | Fournier |
| 6,209,343 | B1 | 4/2001 | Owen |
| 6,220,473 | B1 | 4/2001 | Lehman et al. |
| 6,234,677 | B1 | 5/2001 | Mogil |
| 6,237,776 | B1 | 5/2001 | Mogil |
| 6,244,458 | B1 | 6/2001 | Frysinger et al. |
| 6,247,328 | B1 | 6/2001 | Mogil |
| 6,253,570 | B1 | 7/2001 | Lustig |
| 6,276,579 | B1 | 8/2001 | DeLoach |
| D447,632 | S | 9/2001 | Gisser |
| D447,667 | S | 9/2001 | Schneider et al. |
| 6,286,709 | B1 | 9/2001 | Hudson |
| 6,296,134 | B1 | 10/2001 | Cardinale |
| 6,296,165 | B1 | 10/2001 | Mears |
| 6,298,993 | B1 | 10/2001 | Kalozdi |
| 6,336,342 | B1 | 1/2002 | Zeddies |
| 6,336,577 | B1 | 1/2002 | Harris et al. |
| 6,347,706 | B1 | 2/2002 | D'Ambrosio |
| 6,353,215 | B1 | 3/2002 | Revels et al. |
| D455,934 | S | 4/2002 | Culp et al. |
| 6,363,739 | B1 | 4/2002 | Hodosh et al. |
| D457,307 | S | 5/2002 | Pukall et al. |
| 6,394,325 | B1 | 5/2002 | Taylor |
| 6,409,066 | B1 | 6/2002 | Schneider et al. |
| 6,422,032 | B1 | 7/2002 | Greene |
| 6,427,294 | B1 | 8/2002 | Shibaike et al. |
| 6,439,389 | B1 | 8/2002 | Mogil |
| D464,235 | S | 10/2002 | Jeong |
| D465,134 | S | 11/2002 | Joss |
| 6,481,239 | B2 | 11/2002 | Hodosh et al. |
| D466,291 | S | 12/2002 | Ng |
| 6,495,194 | B2 | 12/2002 | Sato et al. |
| 6,505,479 | B2 | 1/2003 | Defelice et al. |
| 6,511,695 | B1 | 1/2003 | Paquin et al. |
| 6,513,661 | B1 | 2/2003 | Mogil |
| D472,431 | S | 4/2003 | Spence, Jr. |
| 6,554,155 | B1 | 4/2003 | Beggins |
| D474,649 | S | 5/2003 | Spence, Jr. |
| 6,582,124 | B2 | 6/2003 | Mogil |
| D476,481 | S | 7/2003 | Gilbert |
| 6,595,687 | B2 | 7/2003 | Godshaw et al. |
| D478,782 | S | 8/2003 | Li |
| 6,604,649 | B1 | 8/2003 | Campi |
| 6,605,311 | B2 | 8/2003 | Villagran et al. |
| 6,619,447 | B1 | 9/2003 | Garcia, III et al. |
| 6,626,342 | B1 | 9/2003 | Gleason |
| 6,629,430 | B2 | 10/2003 | Mills et al. |
| D482,241 | S | 11/2003 | Tyler |
| 6,640,856 | B1 | 11/2003 | Tucker |
| 6,652,933 | B2 | 11/2003 | Hall |
| 6,655,543 | B2 | 12/2003 | Beuke |
| D485,131 | S | 1/2004 | Lanman et al. |
| D485,732 | S | 1/2004 | Lanman et al. |
| D486,038 | S | 2/2004 | Lanman et al. |

(56) References Cited

U.S. PATENT DOCUMENTS 6,688,470 B2 2/2004 Dege et al.
6,729,758 B1 5/2004 Carter
D491,354 S 6/2004 Chapelier
D492,160 S 6/2004 Lanman et al.
D497,518 S 10/2004 Bellofatto, Jr. et al.
6,799,693 B2 10/2004 Meza
D498,924 S 11/2004 Karl
D501,600 S 2/2005 Guyon
D502,599 S 3/2005 Cabana et al.
D503,279 S 3/2005 Smith
6,874,356 B2 4/2005 Komfeldt et al.
D506,645 S 6/2005 Bellofatto, Jr. et al.
6,925,834 B2 8/2005 Fuchs
D512,274 S 12/2005 Cabey
D515,362 S 2/2006 Chan
D516,099 S 2/2006 Maruyama
D516,870 S 3/2006 Martinez et al.
D517,801 S 3/2006 Woo
D520,306 S 5/2006 Peterson
D522,811 S 6/2006 Martinez et al.
D523,243 S 6/2006 Nashmy
D527,226 S 8/2006 Maldonado
D530,089 S 10/2006 Silverman
7,153,025 B1 12/2006 Jackson et al.
D534,352 S 1/2007 Delafontaine
D534,771 S 1/2007 Zorn
D535,099 S 1/2007 Johansson et al.
D535,820 S 1/2007 Kamiya
7,160,028 B1 1/2007 Linday
7,162,890 B2 1/2007 Mogil et al.
7,172,101 B2 2/2007 Find
D539,033 S 3/2007 Cassegrain
D540,037 S 4/2007 Newson
7,201,285 B2 4/2007 Beggins
7,207,716 B2 4/2007 Buchanan et al.
7,219,814 B2 5/2007 Lown et al.
7,240,513 B1 7/2007 Conforti
D547,941 S 8/2007 Lucena
D548,459 S 8/2007 Harvey
7,252,213 B1 * 8/2007 DeSanto ..... B65D 81/3886 224/148.7
D550,448 S 9/2007 Boje et al.
7,264,134 B2 9/2007 Tulp
D557,667 S 12/2007 Kawamura et al.
7,302,810 B2 12/2007 McCrory
D560,102 S 1/2008 Sumter
7,313,927 B2 1/2008 Barker
7,344,028 B2 3/2008 Hanson
D566,484 S 4/2008 George
7,353,952 B2 4/2008 Swartz et al.
D570,603 S 6/2008 Wu et al.
D573,422 S 7/2008 Tagliati et al.
D574,667 S 8/2008 Grabijas, III et al.
D578,401 S 10/2008 Perry et al.
D582,151 S 12/2008 Gonzalez
D583,152 S 12/2008 Keeney
7,481,065 B2 1/2009 Krieger
D587,010 S 2/2009 Deck
7,527,430 B2 5/2009 Suskind
D598,194 S 8/2009 Turvey et al.
D599,550 S 9/2009 Turvey et al.
7,581,886 B2 9/2009 Nitti
7,597,478 B2 10/2009 Pruchnicki et al.
D603,606 S 11/2009 Wang
7,634,919 B2 12/2009 Bernhard, Jr. et al.
D607,697 S 1/2010 Whitlock et al.
D608,095 S 1/2010 Turvey et al.
D608,096 S 1/2010 Noble
D608,159 S 1/2010 Whitlock et al.
D610,795 S 3/2010 Dejadon
D611,706 S 3/2010 Angles et al.
D612,605 S 3/2010 Turvey et al.
7,669,436 B2 3/2010 Mogil et al.
7,677,406 B2 3/2010 Maxson
7,682,080 B2 3/2010 Mogil
D617,560 S 6/2010 Wu
7,730,739 B2 6/2010 Fuchs
D618,966 S 7/2010 Koehler et al.
D619,423 S 7/2010 Koehler et al.
D619,854 S 7/2010 Koehler et al.
D619,855 S 7/2010 Koehler et al.
7,757,878 B2 7/2010 Mogil et al.
7,762,294 B2 7/2010 Wang
D620,707 S 8/2010 Mogil
D620,708 S 8/2010 Sanz
D621,609 S 8/2010 Hasty
7,775,388 B2 8/2010 Murrer, III
7,784,759 B2 8/2010 Farrell
7,791,003 B2 9/2010 Lockhart et al.
7,811,620 B2 10/2010 Merrill et al.
7,815,069 B1 10/2010 Bellofatto et al.
D626,329 S 11/2010 Chapelier
D627,199 S 11/2010 Pruchnicki
7,841,207 B2 11/2010 Mogil et al.
D629,612 S 12/2010 Weldon
D630,844 S 1/2011 Wang et al.
7,874,177 B2 1/2011 Azamy
7,886,936 B2 2/2011 Helline
7,900,816 B2 3/2011 Kastanek et al.
D638,220 S 5/2011 Chu et al.
D642,870 S 8/2011 Whitlock et al.
7,988,006 B2 8/2011 Mogil et al.
D645,662 S 9/2011 Perez
8,016,090 B2 9/2011 McCoy et al.
8,043,004 B2 10/2011 Mogil
D648,532 S 11/2011 Sosnovsky
8,061,159 B2 11/2011 Mogil et al.
D650,169 S 12/2011 Klifa
8,079,451 B2 12/2011 Rothschild et al.
8,096,442 B2 1/2012 Ramundi
D659,998 S 5/2012 Austin
8,176,749 B2 5/2012 LaMere et al.
D662,316 S 6/2012 Nitkin
8,191,747 B2 6/2012 Pruchnicki
D664,261 S 7/2012 Kravitz et al.
8,209,995 B2 7/2012 Kieling et al.
D666,896 S 9/2012 Pinholster, Jr. et al.
D667,043 S 9/2012 Couch, III
8,281,950 B2 10/2012 Potts et al.
8,292,119 B2 10/2012 Kenneally
8,302,749 B2 11/2012 Melmon et al.
8,327,659 B2 12/2012 Winkler et al.
D673,363 S 1/2013 Crandall
D673,772 S 1/2013 Munson et al.
D674,246 S 1/2013 Scott et al.
D674,664 S 1/2013 Collie
8,424,319 B2 4/2013 Whewell, Jr.
8,424,713 B2 4/2013 Bolland
8,430,284 B2 4/2013 Broadbent et al.
D682,635 S 5/2013 Boroski
D684,767 S 6/2013 Gerbi
8,453,899 B1 6/2013 Calkin
D686,412 S 7/2013 Guichot
8,474,640 B2 7/2013 Armstrong
8,516,848 B2 8/2013 White et al.
D690,100 S 9/2013 Alfaks
8,544,678 B1 10/2013 Hughes
8,573,002 B2 11/2013 Ledoux et al.
D695,568 S 12/2013 Hayes
8,622,235 B2 1/2014 Suchecki
D699,940 S 2/2014 Robert
D699,941 S 2/2014 Robert
8,646,970 B2 2/2014 Mogil
D701,041 S 3/2014 Burnett
D703,946 S 5/2014 Tweedie
8,720,681 B1 5/2014 Hancock et al.
8,720,739 B2 5/2014 Bollis
8,777,045 B2 7/2014 Mitchell et al.
D710,085 S 8/2014 Szewczyk
D711,096 S 8/2014 Hanna
D711,100 S 8/2014 Dingizian
D712,555 S 9/2014 Berg
8,827,109 B1 9/2014 Sheehan
8,844,756 B2 9/2014 Beyburg

(56) References Cited

U.S. PATENT DOCUMENTS

| | | | |
|---|---|---|---|
| D715,544 | S | 10/2014 | Levine |
| 8,857,654 | B2 | 10/2014 | Mogil et al. |
| D717,041 | S | 11/2014 | Pulliam |
| D718,053 | S | 11/2014 | McFreen |
| 8,875,964 | B1 | 11/2014 | Vanderberg |
| 8,893,940 | B2 | 11/2014 | Green et al. |
| D718,931 | S | 12/2014 | Brundl |
| D719,303 | S | 12/2014 | Anderson |
| 8,899,071 | B2 | 12/2014 | Mogil et al. |
| D723,804 | S | 3/2015 | Coleman |
| D725,908 | S | 4/2015 | Zwetzig |
| D728,942 | S | 5/2015 | Byham |
| D732,295 | S | 6/2015 | Aafjes |
| D732,348 | S | 6/2015 | Seiders et al. |
| D732,349 | S | 6/2015 | Seiders et al. |
| D732,350 | S | 6/2015 | Seiders et al. |
| D732,899 | S | 6/2015 | Seiders et al. |
| D734,643 | S | 7/2015 | Boroski |
| D734,992 | S | 7/2015 | Boroski |
| 9,084,463 | B2 | 7/2015 | Merrill |
| D738,108 | S | 9/2015 | Adler et al. |
| D739,654 | S | 9/2015 | Brouard |
| 9,138,033 | B2 | 9/2015 | Kojima et al. |
| 9,139,352 | B2 | 9/2015 | Seiders et al. |
| 9,146,051 | B2 | 9/2015 | Kamin et al. |
| D743,699 | S | 11/2015 | Wieden |
| D744,786 | S | 12/2015 | Bagwell |
| D747,104 | S | 1/2016 | Ford |
| 9,226,558 | B2 | 1/2016 | Armstrong |
| D749,653 | S | 2/2016 | Carnes |
| D750,140 | S | 2/2016 | Cross |
| 9,254,022 | B2 | 2/2016 | Meldeau et al. |
| 9,254,023 | B2 | 2/2016 | Su et al. |
| 9,265,318 | B1 | 2/2016 | Williams et al. |
| D752,347 | S | 3/2016 | Seiders et al. |
| 9,271,553 | B2 | 3/2016 | Ponx |
| 9,272,475 | B2 | 3/2016 | Ranade et al. |
| 9,290,313 | B2 | 3/2016 | De Lesseux et al. |
| D752,860 | S | 4/2016 | Barilaro et al. |
| 9,307,814 | B2 | 4/2016 | Pulliam |
| 9,314,069 | B2 | 4/2016 | Takazawa |
| D756,109 | S | 5/2016 | Hayashi |
| D756,638 | S | 5/2016 | Frisoni |
| 9,366,467 | B2 | 6/2016 | Kiedaisch et al. |
| 9,375,061 | B2 | 6/2016 | Mosee |
| D760,494 | S | 7/2016 | Harvey-Pankey |
| D761,561 | S | 7/2016 | Cheng |
| D762,378 | S | 8/2016 | Domotor et al. |
| D762,384 | S | 8/2016 | Boroski |
| D763,570 | S | 8/2016 | Potts |
| D764,791 | S | 8/2016 | Patel |
| D764,873 | S | 8/2016 | Collie |
| 9,408,445 | B2 | 8/2016 | Mogil et al. |
| D765,395 | S | 9/2016 | Sanz |
| D765,967 | S | 9/2016 | Boroski |
| D766,571 | S | 9/2016 | Boroski |
| D768,981 | S | 10/2016 | Kliot |
| D768,987 | S | 10/2016 | Blumenfeld |
| D769,616 | S | 10/2016 | Keene |
| D770,761 | S | 11/2016 | Deioma et al. |
| D770,763 | S | 11/2016 | Joo et al. |
| D771,372 | S | 11/2016 | Kelly et al. |
| D772,562 | S | 11/2016 | Petre |
| D773,813 | S | 12/2016 | Jakubowski |
| 9,521,883 | B2 | 12/2016 | Matsumoto et al. |
| 9,545,134 | B1 | 1/2017 | Tan |
| D778,045 | S | 2/2017 | Ruddis |
| D778,609 | S | 2/2017 | Gardner et al. |
| D782,820 | S | 4/2017 | Thompson |
| D783,272 | S | 4/2017 | Burton et al. |
| D784,010 | S | 4/2017 | Dumas |
| 9,630,750 | B2 | 4/2017 | Gardner et al. |
| D785,325 | S | 5/2017 | Samrelius et al. |
| D785,930 | S | 5/2017 | Sassi |
| D786,559 | S | 5/2017 | Seiders et al. |
| D786,560 | S | 5/2017 | Seiders et al. |
| D786,561 | S | 5/2017 | Seiders et al. |
| D786,562 | S | 5/2017 | Seiders et al. |
| D787,187 | S | 5/2017 | Seiders et al. |
| D789,080 | S | 6/2017 | Caffagni |
| D789,081 | S | 6/2017 | Sassi |
| D789,082 | S | 6/2017 | Barilaro et al. |
| D792,167 | S | 7/2017 | Bradley |
| D792,486 | S | 7/2017 | Li et al. |
| D793,089 | S | 8/2017 | Jackson |
| D796,185 | S | 9/2017 | Masten |
| D797,454 | S | 9/2017 | Seiders et al. |
| D797,455 | S | 9/2017 | Seiders et al. |
| D798,670 | S | 10/2017 | Seiders et al. |
| D799,276 | S | 10/2017 | Seiders et al. |
| D799,277 | S | 10/2017 | Seiders et al. |
| D799,823 | S | 10/2017 | Schartle |
| D799,905 | S | 10/2017 | Seiders et al. |
| D800,443 | S | 10/2017 | Burton et al. |
| D800,444 | S | 10/2017 | Burton et al. |
| D801,123 | S | 10/2017 | Seiders et al. |
| 9,796,517 | B2 | 10/2017 | Seiders et al. |
| D802,028 | S | 11/2017 | Li |
| D802,029 | S | 11/2017 | Li |
| D802,373 | S | 11/2017 | Seiders et al. |
| D802,630 | S | 11/2017 | Li et al. |
| 9,809,376 | B2 | 11/2017 | Mitchell et al. |
| D805,851 | S | 12/2017 | Sullivan et al. |
| 9,840,178 | B2 | 12/2017 | Baker |
| D808,157 | S | 1/2018 | Viger et al. |
| D808,173 | S | 1/2018 | Seiders et al. |
| D808,175 | S | 1/2018 | Seiders et al. |
| D808,655 | S | 1/2018 | Seiders et al. |
| D808,730 | S | 1/2018 | Sullivan et al. |
| D809,869 | S | 2/2018 | Seiders et al. |
| D811,082 | S | 2/2018 | Lehan |
| 9,901,153 | B2 | 2/2018 | Nash |
| D811,746 | S | 3/2018 | Seiders et al. |
| D813,539 | S | 3/2018 | Van Assche |
| 9,907,369 | B2 | 3/2018 | Kelly et al. |
| D814,879 | S | 4/2018 | Larson et al. |
| D815,496 | S | 4/2018 | Larson et al. |
| 9,943,150 | B2 | 4/2018 | Morrow |
| D817,106 | S | 5/2018 | Larson et al. |
| D817,107 | S | 5/2018 | Larson et al. |
| D817,722 | S | 5/2018 | Bradley |
| D818,707 | S | 5/2018 | Vevers et al. |
| 9,981,780 | B2 | 5/2018 | Delasalle |
| D819,966 | S | 6/2018 | Yu |
| D819,967 | S | 6/2018 | Carter et al. |
| D821,094 | S | 6/2018 | Dragicevic |
| D821,825 | S | 7/2018 | Sullivan et al. |
| D822,987 | S | 7/2018 | Seiders et al. |
| D822,997 | S | 7/2018 | Seiders et al. |
| D822,998 | S | 7/2018 | Seiders et al. |
| D822,999 | S | 7/2018 | Seiders et al. |
| D823,601 | S | 7/2018 | Seiders et al. |
| D823,602 | S | 7/2018 | Seiders et al. |
| 10,010,146 | B2 | 7/2018 | Moore |
| 10,010,162 | B1 | 7/2018 | Woods et al. |
| 10,029,842 | B2 | 7/2018 | Seiders et al. |
| D824,660 | S | 8/2018 | Ross |
| D824,666 | S | 8/2018 | Carter et al. |
| D824,671 | S | 8/2018 | Pennington |
| D824,731 | S | 8/2018 | Sullivan et al. |
| D827,299 | S | 9/2018 | Vickery |
| D828,112 | S | 9/2018 | Furneaux et al. |
| D828,728 | S | 9/2018 | Jacobsen |
| D829,244 | S | 9/2018 | Sullivan et al. |
| D830,048 | S | 10/2018 | McQueeny |
| D830,132 | S | 10/2018 | Sullivan et al. |
| D830,133 | S | 10/2018 | Sullivan et al. |
| D830,134 | S | 10/2018 | Sullivan et al. |
| D832,653 | S | 11/2018 | Waskow et al. |
| 10,138,048 | B2 | 11/2018 | Mitchell et al. |
| D834,815 | S | 12/2018 | Barlier |
| D834,817 | S | 12/2018 | Hoppe et al. |
| D834,895 | S | 12/2018 | Triska et al. |
| D835,473 | S | 12/2018 | Jacobsen |

(56) References Cited

U.S. PATENT DOCUMENTS

| | | | |
|---|---|---|---|
| D835,949 | S | 12/2018 | Triska et al. |
| D835,950 | S | 12/2018 | Jacobsen |
| 10,143,282 | B2 | 12/2018 | Seiders et al. |
| 10,154,714 | B2 | 12/2018 | Wang |
| D836,996 | S | 1/2019 | Jacobsen |
| D836,997 | S | 1/2019 | Jacobsen |
| D836,998 | S | 1/2019 | Jacobsen |
| D836,999 | S | 1/2019 | Jacobsen |
| D837,000 | S | 1/2019 | Jacobsen |
| D837,001 | S | 1/2019 | Jacobsen |
| D838,978 | S | 1/2019 | Lee |
| D839,682 | S | 2/2019 | Jacobsen |
| D840,194 | S | 2/2019 | Furneaux et al. |
| D840,689 | S | 2/2019 | Seiders et al. |
| D840,761 | S | 2/2019 | Seiders et al. |
| D840,762 | S | 2/2019 | Seiders et al. |
| D840,763 | S | 2/2019 | Seiders et al. |
| D840,764 | S | 2/2019 | Seiders et al. |
| D841,325 | S | 2/2019 | Buynar |
| D842,048 | S | 3/2019 | Wells |
| 10,226,110 | B2 | 3/2019 | Hayashi |
| D844,321 | S | 4/2019 | Li |
| D844,975 | S | 4/2019 | Munie et al. |
| D844,976 | S | 4/2019 | Munie et al. |
| D844,977 | S | 4/2019 | Munie et al. |
| D844,978 | S | 4/2019 | Munie et al. |
| D844,979 | S | 4/2019 | Munie et al. |
| D844,992 | S | 4/2019 | Seiders et al. |
| D845,625 | S | 4/2019 | Barlier |
| D846,275 | S | 4/2019 | Barlier |
| 10,244,841 | B2 | 4/2019 | Hayashi |
| D847,500 | S | 5/2019 | Lagerfeld |
| D847,501 | S | 5/2019 | Carter et al. |
| D848,219 | S | 5/2019 | Munie et al. |
| D848,220 | S | 5/2019 | Munie et al. |
| D848,221 | S | 5/2019 | Munie et al. |
| D848,222 | S | 5/2019 | Munie et al. |
| D848,223 | S | 5/2019 | Munie et al. |
| D848,798 | S | 5/2019 | Munie et al. |
| D849,398 | S | 5/2019 | Tan |
| D849,406 | S | 5/2019 | Dehmoubed et al. |
| D849,486 | S | 5/2019 | Munie et al. |
| 10,279,980 | B2 | 5/2019 | James, Jr. |
| D850,107 | S | 6/2019 | Dehmoubed et al. |
| D851,404 | S | 6/2019 | Seiders et al. |
| D851,937 | S | 6/2019 | Fuller |
| 10,314,377 | B2 | 6/2019 | Stephens |
| 10,322,867 | B2 | 6/2019 | Furneaux et al. |
| D853,201 | S | 7/2019 | Collie |
| D853,728 | S | 7/2019 | Seiders et al. |
| D855,982 | S | 8/2019 | McGinn |
| 10,384,855 | B2 | 8/2019 | Seiders et al. |
| D859,812 | S | 9/2019 | Seiders et al. |
| D859,813 | S | 9/2019 | Seiders et al. |
| D859,814 | S | 9/2019 | Seiders et al. |
| D859,815 | S | 9/2019 | Seiders et al. |
| D859,934 | S | 9/2019 | Seiders et al. |
| D860,634 | S | 9/2019 | Seiders et al. |
| 10,413,030 | B1 | 9/2019 | Douglas et al. |
| D861,335 | S | 10/2019 | Barlier |
| D861,338 | S | 10/2019 | Seiders et al. |
| D862,065 | S | 10/2019 | Boys et al. |
| D862,177 | S | 10/2019 | Seiders et al. |
| D862,528 | S | 10/2019 | Sullivan et al. |
| D866,186 | S | 11/2019 | Seiders et al. |
| D867,823 | S | 11/2019 | Jacobsen |
| D868,544 | S | 12/2019 | Lin et al. |
| D869,146 | S | 12/2019 | Jacobsen |
| D871,074 | S | 12/2019 | Seiders et al. |
| D871,765 | S | 1/2020 | Seiders et al. |
| D872,993 | S | 1/2020 | Gu |
| D873,022 | S | 1/2020 | Seip et al. |
| D877,514 | S | 3/2020 | Seiders et al. |
| 10,575,599 | B2 | 3/2020 | Cheng |
| D880,254 | S | 4/2020 | Jacobsen |
| D880,862 | S | 4/2020 | Seiders et al. |
| D881,561 | S | 4/2020 | He |
| D882,956 | S | 5/2020 | Seiders et al. |
| D886,537 | S | 6/2020 | Jacobsen |
| D886,538 | S | 6/2020 | Jacobsen |
| D886,539 | S | 6/2020 | Jacobsen |
| D887,699 | S | 6/2020 | Bullock et al. |
| 10,736,391 | B2 | 8/2020 | Seiders et al. |
| D894,692 | S | 9/2020 | Herold |
| D896,039 | S | 9/2020 | Seiders et al. |
| D896,510 | S | 9/2020 | Wen |
| D896,591 | S | 9/2020 | Seiders et al. |
| 10,781,028 | B2 | 9/2020 | Munie et al. |
| D897,780 | S | 10/2020 | Seiders et al. |
| D899,197 | S | 10/2020 | Seiders et al. |
| D899,865 | S | 10/2020 | Shi |
| 10,806,225 | B2 | 10/2020 | Sitnikova |
| D902,664 | S | 11/2020 | Munie et al. |
| 10,827,808 | B2 | 11/2020 | Seiders et al. |
| D903,305 | S | 12/2020 | Sullivan et al. |
| D904,011 | S | 12/2020 | Sullivan et al. |
| D904,031 | S | 12/2020 | Chandler |
| D904,758 | S | 12/2020 | Bullock et al. |
| D904,830 | S | 12/2020 | Meda et al. |
| D906,058 | S | 12/2020 | Sullivan et al. |
| D907,968 | S | 1/2021 | Sullivan et al. |
| D907,969 | S | 1/2021 | Sullivan et al. |
| D909,063 | S | 2/2021 | Loudenslager et al. |
| D910,382 | S | 2/2021 | Rane et al. |
| 10,952,522 | B2 | 3/2021 | D'Alessandro |
| 10,981,716 | B2 | 4/2021 | Seiders et al. |
| D918,570 | S | 5/2021 | Seiders et al. |
| D918,571 | S | 5/2021 | Davis |
| D919,298 | S | 5/2021 | Munie |
| D919,375 | S | 5/2021 | Seiders et al. |
| D919,376 | S | 5/2021 | Seiders et al. |
| D920,677 | S | 6/2021 | Tertoolen |
| D920,678 | S | 6/2021 | Seiders et al. |
| D921,440 | S | 6/2021 | Munie et al. |
| D922,149 | S | 6/2021 | Munie et al. |
| D922,150 | S | 6/2021 | Munie et al. |
| D922,151 | S | 6/2021 | Munie et al. |
| D922,828 | S | 6/2021 | Munie et al. |
| D923,323 | S | 6/2021 | Seiders et al. |
| D926,532 | S | 8/2021 | Munie et al. |
| D927,262 | S | 8/2021 | Munie et al. |
| D931,614 | S | 9/2021 | Seiders et al. |
| D935,175 | S | 11/2021 | Rogers et al. |
| 11,407,579 | B2 | 8/2022 | Munie et al. |
| 2002/0012480 | A1 | 1/2002 | Konno |
| 2002/0038811 | A1 | 4/2002 | Vigny |
| 2002/0197369 | A1 | 12/2002 | Modler |
| 2003/0070447 | A1 | 4/2003 | Tanaka |
| 2003/0080133 | A1 | 5/2003 | Butler |
| 2003/0106895 | A1 | 6/2003 | Kalal |
| 2003/0106910 | A1 | 6/2003 | Hicks et al. |
| 2003/0110599 | A1 | 6/2003 | Wang |
| 2003/0136702 | A1 | 7/2003 | Redzisz et al. |
| 2003/0149461 | A1 | 8/2003 | Johnson |
| 2003/0175394 | A1 | 9/2003 | Modler |
| 2004/0004111 | A1 | 1/2004 | Cardinale |
| 2004/0028296 | A1 | 2/2004 | Meli |
| 2004/0035143 | A1 | 2/2004 | Mogil |
| 2004/0074936 | A1 | 4/2004 | McDonald |
| 2004/0094589 | A1 | 5/2004 | Fricano |
| 2004/0136621 | A1 | 7/2004 | Mogil |
| 2004/0144783 | A1 | 7/2004 | Anderson et al. |
| 2004/0149600 | A1 | 8/2004 | Wolter et al. |
| 2004/0164084 | A1 | 8/2004 | Cooper |
| 2004/0237266 | A1 | 12/2004 | Wang |
| 2005/0011520 | A1 | 1/2005 | Rowe |
| 2005/0016895 | A1 | 1/2005 | Glenn |
| 2005/0028910 | A1 | 2/2005 | Duty |
| 2005/0034947 | A1 | 2/2005 | Nykoluk |
| 2005/0040199 | A1 | 2/2005 | Lemens et al. |
| 2005/0045520 | A1 | 3/2005 | Johnson |
| 2005/0045521 | A1 | 3/2005 | Johnson et al. |
| 2005/0056669 | A1 | 3/2005 | Lavelle |
| 2005/0072181 | A1 | 4/2005 | Mogil et al. |

(56) References Cited

U.S. PATENT DOCUMENTS

2005/0133399 A1 6/2005 Fidrych
2005/0155891 A1 7/2005 Chen
2005/0183446 A1 8/2005 Fuchs
2005/0196510 A1 9/2005 Walters
2005/0205459 A1 9/2005 Mogil et al.
2005/0262871 A1 12/2005 Bailey-Weston
2005/0263528 A1 12/2005 Maldonado et al.
2005/0279124 A1 12/2005 Maldonado
2006/0007266 A1 1/2006 Silverbrook
2006/0010660 A1 1/2006 Stenhall
2006/0021376 A1 2/2006 Scroggs
2006/0102497 A1 5/2006 Wulf
2006/0151533 A1 7/2006 Simunovic et al.
2006/0201979 A1 9/2006 Achilles
2006/0239593 A1 10/2006 Fidrych
2006/0240159 A1 10/2006 Cash et al.
2006/0248902 A1 11/2006 Hunnell
2006/0289586 A1 12/2006 Gregory
2007/0006430 A1 1/2007 Issler
2007/0012593 A1 1/2007 Kitchens et al.
2007/0017942 A1 1/2007 Hubbell
2007/0137960 A1 6/2007 Redzisz
2007/0148305 A1 6/2007 Sherwood et al.
2007/0148307 A1 6/2007 Sherwood et al.
2007/0164063 A1 7/2007 Concepcion
2007/0199966 A1 8/2007 Korchmar
2007/0215663 A1 9/2007 Chongson et al.
2007/0217187 A1 9/2007 Blakely et al.
2007/0221693 A1 9/2007 Moore
2007/0237432 A1 10/2007 Mogil
2007/0261977 A1 11/2007 Sakai
2007/0274613 A1 11/2007 Pruchnicki et al.
2007/0278234 A1 12/2007 Mogil
2007/0290816 A1 12/2007 Bedard
2008/0038424 A1 2/2008 Krusemann
2008/0073364 A1 3/2008 Simmons
2008/0083629 A1 4/2008 Soucie
2008/0105282 A1 5/2008 Fernholz et al.
2008/0116697 A1 5/2008 D'Ambrosio
2008/0128421 A1 6/2008 Ulbrand et al.
2008/0142518 A1 6/2008 Maistrellis
2008/0160149 A1 7/2008 Nasrallah et al.
2008/0164265 A1 7/2008 Conforti
2008/0178865 A1 7/2008 Retterer
2008/0189918 A1 8/2008 Kusayama
2008/0245096 A1 10/2008 Hanson et al.
2008/0260303 A1 10/2008 De Lesseux et al.
2008/0264925 A1 10/2008 Lockhart et al.
2008/0305235 A1 12/2008 Gao et al.
2009/0029109 A1 1/2009 Seth et al.
2009/0052809 A1 2/2009 Sampson
2009/0080808 A1 3/2009 Hagen
2009/0095757 A1 4/2009 Ramundi
2009/0242619 A1 10/2009 Blomberg
2009/0280229 A1 11/2009 Constantine et al.
2009/0301511 A1 12/2009 Vinci
2009/0311378 A1 12/2009 Wilaschin et al.
2009/0317514 A1 12/2009 Sizer
2010/0005827 A1 1/2010 Winkler
2010/0047423 A1 2/2010 Kruesemann et al.
2010/0059199 A1 3/2010 Court
2010/0071395 A1 3/2010 Ledoux et al.
2010/0075006 A1 3/2010 Semenza
2010/0102057 A1 4/2010 Long et al.
2010/0108694 A1 5/2010 Sedlbauer et al.
2010/0125982 A1 5/2010 Chou
2010/0136203 A1 6/2010 Sakata et al.
2010/0143567 A1 6/2010 Ye et al.
2010/0224660 A1 9/2010 Gleason
2010/0269311 A1 10/2010 Jacobsen
2010/0284631 A1 11/2010 Lee
2010/0284634 A1 11/2010 Hadley
2011/0003975 A1 1/2011 Arase et al.
2011/0005042 A1 1/2011 Thomas et al.
2011/0005739 A1 1/2011 Finney et al.
2011/0030415 A1 2/2011 Breyburg et al.
2011/0036473 A1 2/2011 Chan et al.
2011/0097442 A1 4/2011 Harju et al.
2011/0108562 A1 5/2011 Lyons
2011/0155611 A1 6/2011 Armstrong
2011/0167863 A1 7/2011 Herrbold
2011/0182532 A1 7/2011 Baltus
2011/0191933 A1 8/2011 Gregory et al.
2011/0284601 A1 11/2011 Pullin
2011/0311166 A1 12/2011 Pascua
2012/0106130 A1 5/2012 Beaudette
2012/0137637 A1 6/2012 Gillis
2012/0180184 A1 7/2012 Crye
2012/0181211 A1 7/2012 Charlebois
2012/0187138 A1 7/2012 Vasquez et al.
2012/0261445 A1 10/2012 Demskey
2012/0294550 A1 11/2012 Hassman et al.
2012/0311828 A1 12/2012 Nir
2012/0318808 A1 12/2012 McCormick
2013/0014355 A1 1/2013 Lee
2013/0043285 A1 2/2013 Cordray
2013/0133795 A1 5/2013 Zhou et al.
2013/0174600 A1 7/2013 Sarcinella
2013/0200083 A1 8/2013 Cunningham
2013/0216158 A1 8/2013 Meldeau et al.
2013/0243354 A1 9/2013 Lytle
2013/0264350 A1 10/2013 Handlon et al.
2013/0283845 A1 10/2013 Baumann et al.
2013/0294712 A1 11/2013 Seuk
2013/0341338 A1 12/2013 Mitchell et al.
2014/0023295 A1 1/2014 Wagner
2014/0034543 A1 2/2014 Grubstein
2014/0138378 A1 5/2014 Lequeux
2014/0151172 A1 6/2014 Diaz
2014/0226920 A1 8/2014 Passavia
2014/0248003 A1 9/2014 Mogil et al.
2014/0254956 A1 9/2014 Buell, III
2014/0270590 A1 9/2014 Ostroy
2014/0304954 A1 10/2014 La Rocca et al.
2014/0345314 A1 11/2014 Cox et al.
2014/0353347 A1 12/2014 Fischer
2014/0359978 A1 12/2014 Wang
2014/0366336 A1 12/2014 Chung
2014/0369629 A1 12/2014 De La Fuente Lara
2015/0008242 A1 1/2015 Kpabar, Jr.
2015/0096153 A1 4/2015 Matsumoto et al.
2015/0114024 A1 4/2015 Grepper
2015/0114978 A1 4/2015 James, Jr.
2015/0136796 A1 5/2015 Muehlhauser
2015/0143672 A1 5/2015 Konaka et al.
2015/0164153 A1 6/2015 Tsai
2015/0175338 A1 6/2015 Culp et al.
2015/0201722 A1 7/2015 Brouard
2015/0225164 A1 8/2015 Seiders et al.
2015/0296945 A1 10/2015 Douglas
2015/0305402 A1 10/2015 Bourgoin
2015/0335202 A1 11/2015 Wisner et al.
2015/0353263 A1 12/2015 Seiders et al.
2016/0058142 A1 3/2016 Buynar
2016/0066817 A1 3/2016 Hannes
2016/0095405 A1 4/2016 Wang
2016/0100661 A1 4/2016 Redzisz et al.
2016/0100673 A1 4/2016 Demskey
2016/0101924 A1 4/2016 Mitchell et al.
2016/0107801 A1 4/2016 Armstrong
2016/0107816 A1 4/2016 Larpenteur et al.
2016/0129292 A1* 5/2016 Stroup ..... A63B 23/12
434/247
2016/0198812 A1 7/2016 Tan
2016/0198901 A1 7/2016 De Lesseux et al.
2016/0221722 A1 8/2016 Burke et al.
2016/0236849 A1 8/2016 Seiders et al.
2016/0255943 A1 9/2016 Houston et al.
2016/0257479 A1 9/2016 Seiders et al.
2016/0338462 A1 11/2016 Hayashi
2016/0338908 A1 11/2016 Rice et al.
2016/0355319 A1 12/2016 Stephens
2017/0036844 A1 2/2017 Seiders et al.
2017/0066559 A1 3/2017 Kim et al.

(56) References Cited

U.S. PATENT DOCUMENTS

| | | | | |
|---|---|---|---|---|
| 2017/0071304 | A1 | 3/2017 | Wang | |
| 2017/0071305 | A1 | 3/2017 | Wang | |
| 2017/0099920 | A1 | 4/2017 | Bailey | |
| 2017/0119116 | A1 | 5/2017 | Bradley | |
| 2017/0121059 | A1 | 5/2017 | Faris | |
| 2017/0137205 | A1 | 5/2017 | Graf et al. | |
| 2017/0208907 | A1 | 7/2017 | Chung | |
| 2017/0210542 | A1 | 7/2017 | Seiders et al. | |
| 2017/0225872 | A1 | 8/2017 | Collie | |
| 2017/0265604 | A1 | 9/2017 | Martinson et al. | |
| 2017/0280937 | A1 | 10/2017 | Mogil et al. | |
| 2018/0016084 | A1 | 1/2018 | Xia et al. | |
| 2018/0078008 | A1 | 3/2018 | Sturm | |
| 2018/0087819 | A1 | 3/2018 | Triska et al. | |
| 2018/0098607 | A1 | 4/2018 | Seiders et al. | |
| 2018/0162626 | A1 | 6/2018 | Munie et al. | |
| 2018/0220760 | A1 | 8/2018 | Lin | |
| 2018/0229911 | A1 | 8/2018 | Luo | |
| 2018/0235324 | A1 | 8/2018 | Gordon | |
| 2018/0242701 | A1 | 8/2018 | Seiders et al. | |
| 2018/0252458 | A1 | 9/2018 | Furneaux et al. | |
| 2018/0263346 | A1 | 9/2018 | Stephens | |
| 2018/0279733 | A1 | 10/2018 | Young et al. | |
| 2018/0317620 | A1 | 11/2018 | Larson et al. | |
| 2018/0333603 | A1* | 11/2018 | Peyton ..... | A63B 21/0605 |
| 2018/0360172 | A1 | 12/2018 | Chou | |
| 2018/0370710 | A1 | 12/2018 | Luo | |
| 2019/0008256 | A1 | 1/2019 | Basham | |
| 2019/0037976 | A1 | 2/2019 | Cheng | |
| 2019/0071238 | A1 | 3/2019 | Seiders et al. | |
| 2019/0077577 | A1 | 3/2019 | Brandes | |
| 2019/0133281 | A1 | 5/2019 | Munie et al. | |
| 2019/0142116 | A1 | 5/2019 | Cheng | |
| 2019/0142117 | A1 | 5/2019 | Myerscough et al. | |
| 2019/0170422 | A1 | 6/2019 | Dexter | |
| 2020/0029658 | A1 | 1/2020 | Zhang | |
| 2020/0037711 | A1 | 2/2020 | Kayahara et al. | |
| 2020/0172320 | A1 | 6/2020 | Dong | |
| 2021/0345740 | A1 | 11/2021 | Seiders et al. | |

FOREIGN PATENT DOCUMENTS

| | | | |
|---|---|---|---|
| AU | 201614230 | S | 8/2016 |
| BE | 1015808 | A6 | 9/2005 |
| BR | 302019001991-0001 | | 10/2019 |
| CA | 2243820 | A1 | 1/2000 |
| CA | 89737 | A | 6/2000 |
| CA | 2300014 | A1 | 8/2001 |
| CA | 2327764 | A1 | 6/2002 |
| CA | 2433251 | A1 | 12/2004 |
| CA | 2483802 | A1 | 4/2006 |
| CA | 2498796 | A1 | 9/2006 |
| CA | 2499291 | A1 | 9/2006 |
| CA | 2503473 | A1 | 10/2006 |
| CA | 2548064 | A1 | 11/2007 |
| CA | 2549327 | A1 | 11/2007 |
| CA | 2633223 | A1 | 12/2009 |
| CA | 2782668 | A1 | 12/2013 |
| CA | 163677 | A | 6/2016 |
| CN | 2125339 | U | 12/1992 |
| CN | 2188899 | Y | 2/1995 |
| CN | 2207742 | Y | 9/1995 |
| CN | 2296114 | Y | 11/1998 |
| CN | 1832826 | A | 9/2006 |
| CN | 1883333 | A | 12/2006 |
| CN | 3650531 | | 5/2007 |
| CN | 201062136 | Y | 5/2008 |
| CN | 101284425 | A | 10/2008 |
| CN | 201351017 | Y | 11/2009 |
| CN | 101733364 | A | 6/2010 |
| CN | 201550711 | U | 8/2010 |
| CN | 301447931 | S | 1/2011 |
| CN | 201948200 | U | 8/2011 |
| CN | 101500900 | A | 9/2011 |
| CN | 102232160 | A | 11/2011 |
| CN | 202143500 | U | 2/2012 |
| CN | 301956022 | | 6/2012 |
| CN | 302004566 | S | 7/2012 |
| CN | 102717977 | A | 10/2012 |
| CN | 302137314 | | 10/2012 |
| CN | 202619972 | U | 12/2012 |
| CN | 102858208 | A | 1/2013 |
| CN | 202635944 | U | 1/2013 |
| CN | 202760433 | U | 3/2013 |
| CN | 202807322 | U | 3/2013 |
| CN | 202959175 | U | 6/2013 |
| CN | 203096977 | U | 7/2013 |
| CN | 203096979 | U | 7/2013 |
| CN | 302500079 | S | 7/2013 |
| CN | 302554919 | S | 9/2013 |
| CN | 103385657 | A | 11/2013 |
| CN | 203283602 | U | 11/2013 |
| CN | 302623771 | | 11/2013 |
| CN | 302623775 | | 11/2013 |
| CN | 302738897 | S | 2/2014 |
| CN | 302744932 | S | 2/2014 |
| CN | 302746176 | | 2/2014 |
| CN | 302769710 | | 3/2014 |
| CN | 103763994 | A | 4/2014 |
| CN | 302868215 | | 7/2014 |
| CN | 302877656 | | 7/2014 |
| CN | 104085612 | A | 10/2014 |
| CN | 302956550 | | 10/2014 |
| CN | 204091227 | U | 1/2015 |
| CN | 204120419 | U | 1/2015 |
| CN | 303100086 | | 2/2015 |
| CN | 104709603 | A | 6/2015 |
| CN | 204444667 | U | 7/2015 |
| CN | 104839947 | A | 8/2015 |
| CN | 204548946 | U | 8/2015 |
| CN | 204585423 | U | 8/2015 |
| CN | 303342902 | | 8/2015 |
| CN | 204763894 | U | 11/2015 |
| CN | 204802380 | U | 11/2015 |
| CN | 303459386 | | 11/2015 |
| CN | 105231621 | A | 1/2016 |
| CN | 105520325 | A | 4/2016 |
| CN | 105819110 | A | 8/2016 |
| CN | 105874896 | A | 8/2016 |
| CN | 304154180 | | 6/2017 |
| CN | 304181831 | | 6/2017 |
| CN | 304207295 | | 7/2017 |
| CN | 304259949 | | 8/2017 |
| CN | 304342577 | | 11/2017 |
| CN | 304373532 | | 11/2017 |
| CN | 304527075 | | 3/2018 |
| CN | 304785791 | S | 8/2018 |
| CN | 304906858 | | 11/2018 |
| CN | 208259266 | U | 12/2018 |
| CN | 305025150 | S | 2/2019 |
| CN | 305033965 | S | 2/2019 |
| CN | 305272180 | S | 7/2019 |
| CN | 209807329 | U | 12/2019 |
| CN | 305527294 | S | 1/2020 |
| CN | 305770022 | S | 5/2020 |
| CN | 305873216 | S | 6/2020 |
| CN | 305881796 | S | 6/2020 |
| CN | 305916378 | S | 7/2020 |
| CN | 306245278 | S | 12/2020 |
| CN | 306245283 | S | 12/2020 |
| CN | 306264645 | S | 1/2021 |
| CN | 306365124 | S | 3/2021 |
| CN | 306365279 | S | 3/2021 |
| CN | 306765257 | S | 5/2021 |
| CN | 306616705 | S | 6/2021 |
| CN | 306624319 | S | 6/2021 |
| CN | 306657146 | S | 7/2021 |
| CN | 306674956 | S | 7/2021 |
| DE | 3539626 | C2 | 5/1987 |
| DE | 9309197 | U1 | 11/1993 |
| DE | 20002689 | U1 | 8/2000 |
| DE | 202011050174 | U1 | 7/2011 |
| DE | 202013101115 | U1 | 3/2013 |
| DE | 4020162036690001 | | 10/2017 |

(56) References Cited

FOREIGN PATENT DOCUMENTS

| | | | |
|---|---|---|---|
| DE | 402018000462-0021 | | 9/2018 |
| EM | 000122668-0002 | | 5/2004 |
| EM | 001067250-0003 | | 2/2009 |
| EM | 001188460-0003 | | 2/2010 |
| EM | 001188460-0004 | | 2/2010 |
| EM | 001725466-0003 | S | 7/2010 |
| EM | 001909490-0001 | | 8/2011 |
| EM | 001952722-0008 | | 11/2011 |
| EM | 002073452-0001 | | 8/2012 |
| EM | 002085308-0003 | | 8/2012 |
| EM | 002163527-0017 | | 1/2013 |
| EM | 002182642-0001 | | 2/2013 |
| EM | 002225706-0001 | | 5/2013 |
| EM | 002262436-0001 | | 7/2013 |
| EM | 002264697-0002 | | 7/2013 |
| EM | 002284729-0004 | | 8/2013 |
| EM | 002322552-0001 | | 10/2013 |
| EM | 002476853-0001 | | 6/2014 |
| EM | 002476853-0002 | | 6/2014 |
| EM | 002530519-0001 | | 9/2014 |
| EM | 002605345-0004 | | 12/2014 |
| EM | 002609404-0001 | | 1/2015 |
| EM | 002676536-0001 | | 6/2015 |
| EM | 002745190-0001 | | 9/2015 |
| EM | 003117324-0009 | | 5/2016 |
| EM | 003329929-0001 | | 8/2016 |
| EM | 003409044-0008 | | 10/2016 |
| EM | 003504331-0027 | | 12/2016 |
| EM | 003733021-0001 | | 2/2017 |
| EM | 004100048-0001 | | 9/2017 |
| EM | 004100048-0002 | | 9/2017 |
| EM | 005303559-0001 | | 7/2018 |
| EM | 003328608-0009 | | 2/2019 |
| EM | 005954534-0001 | | 3/2019 |
| EM | 005954534-0002 | | 3/2019 |
| EM | 005954534-0003 | | 3/2019 |
| EM | 005954534-0004 | | 3/2019 |
| EM | 007558580-0001 | | 5/2020 |
| EM | 008206833-0014 | | 10/2020 |
| EM | 008206833-0015 | | 10/2020 |
| EM | 008206833-0016 | | 10/2020 |
| EM | 008149702-0001 | | 11/2020 |
| EM | 008149702-0002 | | 11/2020 |
| EM | 006820619-0001 | | 12/2020 |
| EM | 008306195-0001 | | 12/2020 |
| EM | 008592307-0001 | | 7/2021 |
| EP | 0037545 | A2 | 10/1981 |
| EP | 0082131 | A2 | 6/1983 |
| EP | 85534 | A1 | 8/1983 |
| EP | 0158634 | A1 | 10/1985 |
| EP | 0174159 | A2 | 3/1986 |
| EP | 0238932 | A1 | 9/1987 |
| EP | 1386557 | B1 | 4/2007 |
| EP | 2281961 | A1 | 2/2011 |
| EP | 2461711 | | 6/2012 |
| EP | 3020303 | A1 | 5/2016 |
| EP | 003811264-0010 | | 3/2017 |
| EP | 003841857-0002 | | 4/2017 |
| EP | 004122430-0001 | | 8/2017 |
| EP | 004162337-0001 | | 9/2017 |
| EP | 004162337-0002 | | 9/2017 |
| EP | 004162337-0003 | | 9/2017 |
| EP | 004162337-0004 | | 9/2017 |
| EP | 004162337-0005 | | 9/2017 |
| EP | 004162337-0006 | | 9/2017 |
| EP | 004424059-0002 | | 10/2017 |
| EP | 004417749-0003 | | 11/2017 |
| EP | 004494086-0016 | | 11/2017 |
| EP | 004494086-0017 | | 11/2017 |
| EP | 002719245-0001 | | 1/2018 |
| EP | 005269248-0002 | | 5/2018 |
| EP | 005303559-0003 | | 7/2018 |
| EP | 008149702-0003 | | 11/2020 |
| ES | D0530973-34 | | 1/2020 |
| FR | 1269009 | A | 8/1961 |
| FR | 2440886 | A1 | 6/1980 |
| FR | 20182961-001 | | 9/2018 |
| GB | 191415563 | A | 6/1915 |
| GB | 968422 | A | 9/1964 |
| GB | 1600133 | A | 10/1981 |
| GB | 2225103 | A | 5/1990 |
| GB | 2249717 | A | 5/1992 |
| GB | 2023549 | A | 9/1992 |
| GB | 2282874 | A | 4/1995 |
| GB | 2335972 | A | 10/1999 |
| GB | 3004135 | | 9/2002 |
| GB | 3006367 | | 10/2002 |
| GB | 6028395 | | 2/2018 |
| GB | 9008149702-0001 | | 8/2020 |
| GB | 9008149702-0002 | | 8/2020 |
| GB | 9008149702-0003 | | 8/2020 |
| GB | 9008306195-0001 | | 12/2020 |
| JP | S474767 | Y1 | 2/1972 |
| JP | 11051532 | | 2/1999 |
| JP | 3059471 | U | 7/1999 |
| JP | 2000157335 | A | 6/2000 |
| JP | 1123533 | S | 10/2001 |
| JP | 3275477 | B2 | 4/2002 |
| JP | D1160335 | | 12/2002 |
| JP | 2003026258 | A | 1/2003 |
| JP | 2004073820 | A | 3/2004 |
| JP | 2004238003 | A | 8/2004 |
| JP | D1213384 | | 8/2004 |
| JP | D1242111 | | 6/2005 |
| JP | 2010023926 | A | 2/2010 |
| JP | D1445624 | | 7/2012 |
| JP | D1469606 | | 5/2013 |
| JP | 2015107825 | A | 6/2015 |
| JP | D1531414 | | 8/2015 |
| JP | D1543325 | | 8/2015 |
| JP | D1658594 | | 4/2020 |
| KR | 200177739 | Y1 | 5/2000 |
| KR | 20020027739 | A | 4/2002 |
| KR | 30-0311990 | | 11/2002 |
| KR | 20040092730 | A | 11/2004 |
| KR | 30-0467684 | | 11/2007 |
| KR | 20110124449 | A | 11/2011 |
| KR | 101228371 | B1 | 1/2013 |
| KR | 101282512 | B1 | 7/2013 |
| KR | 300778570.0000 | | 1/2015 |
| KR | 300808669.0000 | | 8/2015 |
| KR | 300835242.0000 | | 1/2016 |
| KR | 300853718.0000 | | 5/2016 |
| KR | 300967041.0000 | | 8/2018 |
| KR | 300968949.0000 | | 8/2018 |
| KR | 300978269.0000 | | 10/2018 |
| KR | 300982993.0000 | | 11/2018 |
| KR | 300984157.0000 | | 12/2018 |
| KR | 200488239 | Y1 | 1/2019 |
| KR | 300990517.0000 | | 1/2019 |
| KR | 300990523.0000 | | 1/2019 |
| KR | 301004401.0000 | | 4/2019 |
| KR | 301062695.0000 | | 6/2020 |
| KR | 301084294.0000 | | 11/2020 |
| KR | 301108516.0000 | | 5/2021 |
| KR | 3020210000796 | | 7/2021 |
| KR | 301123726.0000 | | 8/2021 |
| SG | 93463 | A1 | 1/2003 |
| TW | 126351 | | 1/1990 |
| TW | M572678 | U | 1/2019 |
| WO | 9524146 | A2 | 9/1995 |
| WO | 9812954 | A1 | 4/1998 |
| WO | 02058500 | A1 | 8/2002 |
| WO | 2006007266 | A2 | 1/2006 |
| WO | 2006058538 | A1 | 6/2006 |
| WO | 2007016092 | A2 | 2/2007 |
| WO | 2010106296 | A2 | 9/2010 |
| WO | 2010120199 | A1 | 10/2010 |
| WO | 2012003543 | A1 | 1/2012 |
| WO | 2014033450 | A1 | 3/2014 |
| WO | 2014066026 | A1 | 5/2014 |
| WO | 2016066817 | A1 | 5/2016 |
| WO | 2017091761 | A1 | 6/2017 |
| WO | 2017136754 | A1 | 8/2017 |

(56) References Cited

FOREIGN PATENT DOCUMENTS

| | | | |
|---|---|---|---|
| WO | 17197230 | A1 | 11/2017 |
| WO | 2018152402 | A1 | 8/2018 |
| WO | 2018165426 | A1 | 9/2018 |
| WO | 2018227047 | A1 | 12/2018 |
| WO | 2019135922 | A1 | 7/2019 |

OTHER PUBLICATIONS amazon.com, "Zuzuro Lunch Bag Insulated Cooler Lunch Box w/ 3 Compartment—Heavy-Duty Fabric, Strong SBS Zippers—Includes 3 Meal Prep Lunch box Containers + 2 Ice Packs. For Men Women Adults (Black)," visited May 7, 2019 at <https://www.amazon.com/Zuzuro-Lunch-Insulated-Cooler-Compartment/dp/B079DZ2L1F/ref=sr_1_14?keywords=lunch+box+lid+ice+pack&qid=1557245496&s=gateway&sr=8-14>.

amazon.com, "Srotek Lunch Bag Insulated Lunch Box Tote Bag Cooler Bag Water-resistant Cute Lunch Bag Wide-open Thermal Tote Kit for Women/Girls/Work/Picnic, Grey Flamingo," visited May 7, 2019 at <https://www.amazon.com/dp/B07N57JSJS/ref=sspa_dk_detail_9?psc=1&pd_rd_i=B07N57JSJS>.

amazon.com, "Mier Insulated Double Casserole Carrier Thermal Lunch Tote for Potluck Parties, Picnic, Beach—Fits 9"×13" Casserole Dish, Expandable, Orange," visited May 7, 2019 at <https://www.amazon.com/MIER-Insulated-Casserole-Carrier-Thermal/dp/B01N0PW119/>.

amazon.com, "Lifewit Insulated Casserole Dish Carrier Thermal Lasagna Lugger for Potluck Parties/Picnic/Beach, Lunch Bag to Keep Food Hot/Cold, 16.3×12.6×4.7", Grey," visited May 7, 2019 at <https://www.amazon.com/dp/B07BFWJPV5/ref=sspa_dk_detail_6?psc=1&pd_rd_i=B07BFWJPV5&pd_rd_w=tr7Ke&pf_rd_p=46cdcfa7-b302-4268-b799-8f7d8cb5008b&pd_rd_wg=jq3TO&pf_rd_r=W7MFCBJR9DR0HV3AKZZB&pd_rd_r=604844a0-70d3-11e9-ad99-d763d3fc76f8>.

amazon.com, "Arctic Zone 2008IL515B42 Thermal Insulated Hot/Cold Food Carrier, Green," visited May 7, 2019 at <https://www.amazon.com/dp/B077T7FZBX/ref=sspa_dk_detail_0?psc=1&pd_rd_i=B077T7FZBX>.

amazon.com, "Lille 22oz Stainless Steel Leakproof Lunch Box, Insulated Bento Boxes | Thermal Food Container with Insulated Lunch Bag for Work | 2nd Gen with Durable Handle and Lid | BPA free | Adult, Women, Kid," visited May 7, 2019 at <https://www.amazon.com/Lille-Stainless-Leakproof-Insulated-Container/dp/B07HDTMJ7M/>.

Stopper Dry Bag, http://www.seatosummit.com/products/display/181, published date unknown, but prior to the filing date of the present application, Sea To Summit, United States.

Icemule Classic Cooler—Large (20L), http://www.icemulecooler.com/icemule-classic-cooler-large-20l/, published date unknown, but prior to the filing date of the present application, Icemule, United States.

Devonbuy.com: Thule Gauntlet 13" MacBook Pro Attaché. Published on Jul. 28, 2014. Retrieved from the internet at <http://www.devonbuy.com/thule-gauntlet-13-macbook-pro-attache/>, Feb. 24, 2016 9 pages.

United States District Court for the Western District of Texas, Austin Division, "Defendants' Answer and Counterclaims to YETI's Complaint," *YETI Coolers, LLC*, vs. *RTIC Soft Sided Coolers, LLC, RTIC Coolers, LLC, RTIC Web Services, LLC, and Corporate Support and Fulfillment, LLC*, Case 1:16-cv-00909-RP, Document 11, Filed Aug. 18, 2016, 44 pages.

United States District Court Western District of Texas, Austin Division, "Complaint," *YETI Coolers, LLC*, v. *RTIC Soft Side Coolers, RTIC Coolers, LLC, RTIC Web Services, LLC, and Corporate Support and Fulfillment, LLC*, Case 1:16-cv-00909, Document 1, Filed Jul. 27, 2016, 66 pages.

United States District Court Western District of Texas, Austin Division, "Complaint for Damages and Injunctive Relief," *YETI Coolers, LLC* v. *Jennifer Leverne Bootz Evans d/b/a Bling and Burlap Buy In's and Blanks*, Case 1:15-cv-00995, Document 1, Filed Nov. 2, 2015, 128 pages.

United States District Court Western District of Texas, Austin Division, "Order," *YETI Coolers, LLC* v. *Jennifer Leverne Bootz Evans d/b/a Bling and Burlap Buy In's and Blanks*, Case 1:15-cv-00995-RP, Document 18, Filed Apr. 18, 2016, 1 page.

United States District Court Western District of Texas, Austin Division, "Defendant's Reply in Support of Their Rule 12 (B)(6) Motion to Dismiss for Failure to State a Claim" *YETI Coolers, LLC* v. *RTIC Soft Sided Coolers, LLC, RTIC Coolers, LLC, RTIC Web Services, LLC, and Corporate Support and Fulfillment, LLC*, Case 1:16-cv-00909-RP, Document 15, Filed Sep. 8, 2016, 13 pages.

United States District Court Western District of Texas, Austin Division, "YETI's Answer to RTIC's Counterclaims," *YETI Coolers, LLC* v. *RTIC Soft Sided Coolers, LLC, RTIC Coolers, LLC, RTIC Web Services, LLC, and Corporate Support and Fulfillment, LLC*, Case 1:16-cv-00909-RP, Document 14, Filed Sep. 2, 2016, 16 pages.

United States District Court Western District of Texas, Austin Division, "YETI's Opposition to RTIC's Motion to Dismiss," *YETI Coolers, LLC* v. *RTIC Soft Sided Coolers, LLC, RTIC Coolers, LLC, RTIC Web Services, LLC, and Corporate Support and Fulfillment, LLC*, Case 1:16-cv-00909-RP, Document 13, Filed Sep. 1, 2016, 17 pages.

United States District Court for the Western District of Texas, Austin Division, "Defendants' Rule 12(B)(6) Motion to Dismiss for Failure to State a Claim," *YETI Coolers, LLC*, vs. *RTIC Soft Sided Coolers, LLC, RTIC Coolers, LLC, RTIC Web Services, LLC, and Corporate Support and Fulfillment, LLC*, Case 1:16-cv-00909-RP, Document 10, Filed Aug. 18, 2016, 12 pages.

United States District Court for the Western District of Texas, Austin Division, "Joint Rule 26(f) Report and Discovery Plan," *YETI Coolers, LLC*, vs. *RTIC Soft Sided Coolers, LLC, RTIC Coolers, LLC, RTIC Web Services, LLC, and Corporate Support and Fulfillment, LLC*, Case 1:16-cv-00909-RP, Document 19, Filed Oct. 11, 2016, 9 pages.

Petition for Inter Partes Review of U.S. Pat. No. 9139352, filed on Dec. 13, 2016, 1616 pages.

TheGadgeteer.com: Tom Bihn Camera I-O Bag Review. Published Jul. 9, 2012. Retrieved from the internet at <http://the-gadgeteer.com/2012/07/09/tom-bihn-camera-i-o-bag-review/>, Jan. 11, 2016. 7 pages.

YouTube-com: Patagonia Black Hole Duffel 60L. Published Aug. 26, 2013. Retrieved from the internet at <https://www.youtube.com/watch?v=W-PWEmZmVv8>, Dec. 19, 2016. 1 page.

Youtube, "YETI Hopper Cooler at Icast 2014", Uploaded by user TackleDirect on Jul. 17, 2014, Accessed Jan. 31, 2017. (https://www.youtube com/watch?v=A2rKRdyZcZ4).

Ebags, Picnic Pack Picnic Pack Large Insulated Cooler Tote, First reviewed on Jul. 20, 2016. Accessed Feb. 7, 2017. (http://www.ebags.com/product/picnic-pack/picnic-pack-large-insulated-cooler-tote/313704?productid=10428840).

United States Patent and Trademark Office Before the Patent Trial and Appeal Board, Decisions Joint Motions to Terminate Inter Partes Review, Entered Mar. 22, 2017—(4 pgs).

Jan. 31, 2017—(WO) International Search Report and Written Opinion—App. PCT/US2016/060135.

Mar. 27, 2017—(WO) International Search Report and Written Opinion—App PCT/US2017/016552.

May 8, 2017—U.S. Non-Final Office Action—U.S. Appl. No. 15/154,626.

May 22, 2015—U.S. Non-Final Office Action—U.S. Appl. No. 14/479,607.

United States District Court Western District of Texas Austin Division, "Complaint," *YETI Coolers, LLC* v. *Glacier Coolers, LLC, and Tecomate Holdings, LLC*, Case 1:17-cv-00586, Document 1, filed Jun. 15, 2017, 161 pages.

May 30, 2017—(WO) ISR—App. No. PCT/US17/32351.

May 30, 2017—(WO) Written Opinion—App. No. PCT/US17/32351.

(56) References Cited

OTHER PUBLICATIONS

Vimeo, "Cleaning Your YETI Hopper" uploaded by user YETI Coolers on Nov. 4, 2014, Accessed Sep. 27, 2017.(https://vimeo.com/11 0890075).
Sep. 13, 2017—U.S. Final Office Action—U.S. Appl. No. 15/137,838.
Nov. 24, 2017—U.S. Final Office Action—U.S. Appl. No. 15/154,626.
Good Housekeeping, "Lands' End Zip Top Cooler Tote #433786", Reviewed on Apr. 2014, Accessed Nov. 18, 2017. (http://www.goodhousekeeping.com/travel-products/food-cooler-reviews/a33270/lands-end-zip-top-cooler-tote-433786/).
Home Shopping Network, "Built New York Large Welded Cooler Bag", Accessed Nov. 18, 2017. (https://www.hsn.com/products/built-new-york-large-welded-cooler-bag/8561 033).
Feb. 9, 2018—U.S. Non-Final Office Action—U.S. Appl. No. 15/451,064.
May 24, 2018—U.S. Non-final Office Action—U.S. Appl. No. 15/790,926.
Aug. 29, 2018 (WO)—International Search Report and Written Opinion—App. No. PCT/US18/36608.
Mar. 21, 2019—(WO) International Search Report and Written Opinion—App. No. PCT/US2018/066040.
Feb. 4, 2019—(AU) Examination Report—App. No. 2017263566.
Jul. 3, 2019—(CN) First Office Action—App. No. 201780042659.5.
Jun. 5, 2019—(AU) Notice of Acceptance for Patent Application—App 2017263566.
Oct. 2, 2019—(CN) Examiner's Report—App. No. 2017032351.
Jun. 3, 2019—(CN) First Office Action—App. No. 201680076714.8.
Dec. 13, 2019—(CN) First Office Action—App. No. 201780020473.
United States District Court Western District of Texas, Austin Division, "Complaint for Damages and Injunctive Relief," *YETI Coolers, LLC* v. *Olympia Tools International, Inc. d/b/a Coho Outdoors*, Case 1:19-cv-00912, Document 1, Filed Sep. 16, 2019, 235 pages.
United States District Court Western District of Texas, Austin Division, "Defendant Olympia Tools International, Inc. d/b/a Coho Outdoors' Answer and Counterclaims to Plaintiff's Original Complaint," *YETI Coolers, LLC* v. *Olympia Tools International, Inc. d/b/a Coho Outdoors*, Case 1:19-cv-00912, filed Dec. 18, 2019, 48 pages.
Translation of FR 1269009A, Jackson, Jr., Jun. 26, 1961, p. 1, Fig. 2 (Year: 1961).
Jan. 20, 2023—(CN) Office Action No. 1—App. No. 202111319865.0.
Jan. 20, 2023—(MX) Office Action—App. No. MX/a/2018/013890.
Jan. 25, 2023—(JP) Office Action—App. No. 2020531697.
Dec. 6, 2022—(EP) Office Action—App. No. 18813247.6.
Mar. 20, 2020—(CN) Office Action—App. No. 201680076714.8.
Jul. 14, 2020—(CA) Office Action—App. No. 3024101.
First Look: YETI Hopper Flip Soft Cooler Review | GearJunkie which was published on the website; https//gearjunkie.com/review-yeti-hopper-flip-12-soft-cooler on Jul. 12, 2016.
YETI Flip Review—YouTube which was published on the website https://www.youtube.com/watch?v=97Vdb3Iazdw on Sep. 8, 2016.
Jul. 2, 2020—(AU) First Office Action—App. No. 201712263.
Jul. 2, 2020—(AU) First Office Action—App. No. 201712262.
Jul. 2, 2020—(AU) First Office Action—App. No. 201712264.
Jul. 2, 2020—(AU) First Office Action—App. No. 201712265.
Jul. 31, 2020—(CN) Second Office Action (with English Translation)—App. No. 201780020473.X.
Aug. 17, 2020—(CN) Third Office Action (with English Translation)—App. No. 201680076714.8.
Oct. 19, 2020—(NZ) Patent Examination Report 1—App. No. 759046.
amazon.com, "Meal Prep Lunch Bag/Box for Men, Women+3 Large Food Containers (45oz)+2 Big Reusable Ice Packs+Shoulder Strap+Shaker With Storage. Insulated Lunchbox Cooler Tote. Adult Portion Control Set," visited May 7, 2019 at <https://www.amazon.com/Meal-Containers-Reusable-Shoulder-Insulated/dp/B01MU2YS18/>.
amazon.com, "Mier Portable Thermal Insulated Cooler Bag Mini Lunch Bag for Kids, Black," visited May 7, 2019, at <https://www.amazon.com/MIER-Portable-Thermal-Insulated-Cooler/dp/B01145L2JM/>.
Jan. 12, 2021—(CN) Fourth Office Action—App. No. 201680076714.8.
Feb. 3, 2021—(EP) Extended Search Report—App. No. 18813247.6.
United States District Court Southern District of Texas Houston Division, "Plaintiff YETI's Complaint for Patent Infringement", *YETI Coolers, LLC* v. *Igloo Products Corporation*, Case 4:21-cv-00505, filed Feb. 12, 2021, 98 pages.
Feb. 24, 2021—(WO) International Search Report & Written Opinion—PCT/US20/059783.
United States District Court Western District of Texas, Austin Division, "Complaint for Damages and Injunctive Relief for: (1)-(12) Patent Infringement in Violation of 35 U.S.C. § 271; and (13) Breach of Contract", *YETI Coolers, LLC* v. *RTIC Outdoors, LLC; and Corporate Support & Fulfillment, LLC*, Case 1:21-cv-00214, filed Mar. 5, 2021, 338 pages.
Apr. 7, 2021—(NZ) Examination Report 2—App. No. 759046.
Apr. 6, 2021—(CN) First Office Action—App. No. 201880035443.0.
Apr. 26, 2021—(CN) Rejection Decision—App. No. 201680076714.8.
United States District Court Western District of Texas, Austin Division, "First Amended Complaint, 'Complaint for Damages and Injunctive Relief for: (1)-(15) Patent Infringement in Violation of 35 U.S.C. § 271; and (16) Breach of Contract'", *YETI Coolers, LLC* v. *RTIC Outdoors, LLC; and Corporate Support & Fulfillment, LLC*, Case 1:21-cv-00214-RP, Document 10, filed Jun. 2, 2021, 39 pages.
United States District Court Western District of Texas, Austin Division, "Answer of Defendants RTIC Outdoors, LLC and Corporate Support & Fulfillment, LLC to YETI's Amended Complaint: (1)-(15) Patent Infringement in Violation of 35 U.S.C. § 271; and (16) Breach of Contract", *YETI Coolers, LLC* v. *RTIC Outdoors, LLC; and Corporate Support & Fulfillment, LLC*, Case 1:21-cv-00214-RP, Document 16, filed Jun. 17, 2021, 79 pages.
United States District Court Eastern District of Missouri Eastern Division, "Complaint, 'Complaint for Damages and Injunctive Relief'", *YETI Coolers, LLC* v. *Discover Home Products, LLC*, Case 4:21-cv-00836, Document 1, filed Jul. 9, 2021, 68 pages.
Jan. 20, 2021—(CN) Third Office Action—App. No. 201780020473.X.
May 7, 2021—(CN) Rejection Decision—App. No. 201780020473.X.
amazon.com, "Lille Home 2nd Gen 22oz Stainless Steel Leakproof Lunch Box, Insulated Bento Box/Food Container with Insulated Lunch Bag | Durable Handles and Lid | Adults, Kids | Men, Women (Green)," visited May 8, 2019 at <https://www.amazon.com/dp/B07MBDD29C/>.
Jun. 28, 2021—(EP) Office Action—App. No. 18830667.4.
Sep. 3, 2021—(CN) First Office Action—App. No. 201880070523.X.
Jun. 16, 2021—(CN) Evaluation Report of Design Patent—App. No. ZL201630369163.7.
Nov. 16, 2021—(CN) Second Office Action—App. No. 201880035443.0.
United States District Court Western District of Texas, Austin Division, "Second Amended Complaint", *YETI Coolers, LLC* v. *RTIC Outdoors, LLC; and Corporate Support & Fulfillment, LLC*, Case 1:21-cv-00214-RP, Document 33, filed Dec. 17, 2021, 489 pages.
United Stated District Court Western District of Texas, Austin Division, "Answer of Defendants RTIC Outdoors, LLC and Corporate Support & Fulfillment, LLC to YETI's Second Amended Complaint, Jury Trial Demanded", *YETI Coolers, LLC* v. *RTIC Outdoors, LLC; and Corporate Support & Fulfillment, LLC*, Case 1:21-cv-00214-RP, Document 34, filed Jan. 3, 2022, 92 pgs.
Jan. 21, 2022—(JP) Office Action—App. No. 2019-566329.
Jan. 26, 2022—(EP) Office Action—App. No. 18830667.4.
United States District Court Western District of Texas Austin Division, "Defendants RTIC Outdoors, LLC's and Corporate Sup-

(56) References Cited

OTHER PUBLICATIONS port & Fulfillment, LLC's Invalidity Contentions", *YETI Coolers, LLC* v. *RTIC Outdoors, LLC and Corporate Support & Fulfillment, LLC*, Case No. 1:21-cv-00214, Jury Trial Demanded, filed Jan. 17, 2022, 3173 pages.
Exhibits C-8, D-6, E-6, and F-6 "Filson Rugged Twill Bucket Bag", U.S. District Court Western District of Texas, "Defendants RTIC Outdoors, LLC's and Corporate Support & Fulfillment, LLC's Invalidity Contentions", *YETI Coolers, LLC* v *RTIC Outdoors, LLC*, Case No. 1:21-cv-00214, Jan. 17, 2022, pp. 486-491, 568-582, 649-661, and 722-735.
Apr. 13, 2022—(CN) Third Office Action—App. No. 201880035443.0.
Apr. 19, 2022—(CN) Second Office Action—App. No. 201880070523.X.
Jul. 8, 2022—(JP) Decision of Rejection—App. No. 2019566329.
Jul. 15, 2022—(CN) Decision on Rejection—App. No. 201880035443.0.
Jul. 22, 2022—(CN) Third Office Action—App. No. 201880070523.X.
Jul. 27, 2022—(MX) First Office Action—App. No. MX/a/2018/013890.
Sep. 20, 2022—(EP) Second Office Action—App. No. 18830667.4.
Nov. 1, 2022—(CN) Decision of Rejection—App. No. 201880070523X.
Nov. 24, 2022—(CN) Fourth Office Action—App. No. 201880035443.0.
Jun. 27, 2023—(AU) Examination Report No. 1—App. No. 2020382555.
Jul. 4, 2023—(JP) Office Action—App. No. 2022-527686.
Aug. 24, 2023—(CA) Office Action—App. No. 3160474.

* cited by examiner

INSULATING DEVICE

CROSS-REFERENCE TO RELATED APPLICATIONS

This application is a continuation of U.S. patent application Ser. No. 17/563,821, filed Dec. 28, 2021, which is a continuation of U.S. patent application Ser. No. 16/685,124, filed Nov. 15, 2019, entitled Insulating Device, which are herein incorporated by reference in their entirety.

FIELD OF INVENTION

The present disclosure relates generally to non-rigid, portable, insulated devices or containers useful for keeping food and beverages cool or warm, and, more particularly, a soft-sided insulated lunchbox.

BACKGROUND

Insulated devices or lunchboxes are designed to keep food and beverages at lower temperatures. The containers may be composed of flexible materials such as fabric or foams. Insulated lunchboxes may be designed to promote portability. The lunchboxes may include straps and/or handles and may in certain instances be made of lighter weight materials to facilitate mobility. The lunchboxes may include a closure that can open and close a lid to a body of the lunchbox either allow or prevent access to the storage compartment and its interior contents.

BRIEF SUMMARY

This Summary provides an introduction to some general concepts relating to this disclosure in a simplified form that are further described below in the Detailed Description. This Summary is not intended to identify key features or essential features of the disclosure.

Aspects of the disclosure herein may relate an insulating device that includes a body assembly, where the body assembly includes a bottom layer, a first sidewall attached to the bottom layer, an inner liner, and an insulating layer, where at least a portion of the insulating layer is positioned between the first sidewall and the inner liner, and a lid assembly rotatably connected to the body assembly, where the lid assembly includes an upper layer, a lid insulating layer, and a lid liner. A storage compartment may be formed by the body assembly and the lid assembly, where the insulating device has an open configuration providing access to the storage compartment and a closed configuration preventing access to the storage compartment. A closure may be positioned between the body assembly and the lid assembly, where the closure is adapted to selectively connect the body assembly and the lid assembly, and an insulated tab may be formed from a portion of the inner liner and a portion of the insulating layer, where the insulated tab is within the storage compartment and inward of the closure and having a distal end positioned above a midpoint of the closure. The lid assembly may include perimeter edges that extend upward away from the body assembly, where the perimeter edges have an edge height defined as a vertical height from a top surface of the perimeter edges to a top surface of the upper layer, where the edge height is at least 2 times greater than a thickness of the lid insulating layer. In addition, the perimeter edges may have an edge height defined as a vertical height from a top surface of the perimeter edges, where the edge height may be within a range of 10 percent and 20 percent of a total height and 20 percent of the insulating device. The closure may be attached to the first sidewall with a connection element, where the connection element extends through the closure, the first sidewall, the inner liner, and the insulating layer when viewed in a cross-section formed by a vertical plane extending perpendicular to a bottom surface of the insulating device.

Other aspects of this disclosure may relate to an insulating device having an insulated tab behind the closure, where the insulated tab is formed from a portion of the inner liner, and the inner liner forms an outward facing layer of the insulated tab and an inward facing layer of the insulated tab. The inner liner may extend around the insulating layer from the inward facing layer to the outward facing layer, where the insulated tab is connected to the closure at a base end. The insulated tab is may be connected to the closure at the base end via a connection element that extends through the inward facing layer, the outward facing layer, the closure, the first sidewall, and the insulating layer when viewed in a cross-section formed by a vertical plane extending perpendicular to a bottom surface of the insulating device. The insulated tab may extend along a length of the closure to insulate the storage compartment along the length of the closure. As another option, the insulated tab may include a first magnetic element that engages a second magnetic element on the lid assembly when the insulating device is in the closed configuration. The first magnetic element may be positioned between the inner liner and the insulating layer, and the second magnetic element may be positioned between the lid liner and the lid insulating layer.

Still other aspects of this disclosure may relate to an insulating device that includes a body assembly, where the body assembly includes a bottom layer, a sidewall attached to the bottom layer, an inner liner, and an insulating layer, where at least a portion of the insulating layer is positioned between the bottom layer and the inner liner, a lid assembly rotatably connected to the body assembly, where the lid assembly includes an upper layer, a lid insulating layer, and a lid liner. A storage compartment may be formed by the body assembly and the lid assembly, where the insulating device has an open configuration providing access to the storage compartment and a closed configuration. A closure adapted to selectively connect the body assembly and the lid assembly, and a tab, at least partially formed from a portion of the inner liner, where the tab is within the storage compartment and located inward of the closure. The tab may have a distal end positioned above a midpoint of the closure, where the tab may include a first magnetic element that engages a second magnetic element on the lid assembly when the insulating device is in the closed configuration. In some embodiments, the tab may contact the lid liner on the lid assembly when the insulating device is in the closed configuration. The upper layer of the lid assembly may include perimeter edges that extend upward away from the body assembly, where the perimeter edges have an edge height defined as a vertical height from a top surface of the perimeter edges. The edge height may be at least 2 times greater than a thickness of the lid insulating layer. The upper layer may be formed from a foam rubber material. In addition, the lid assembly and the body assembly may be connected by a hinge on one side of the insulating device, wherein the hinge is formed by a second sidewall that extends from the bottom layer of the body assembly to the upper layer of the lid liner of the lid assembly. The tab may also include a portion of the insulating layer enclosed within the inner liner.

Yet other aspects of this disclosure may relate to an insulating device comprising a body assembly, where the body assembly includes a bottom layer, a first sidewall attached to the bottom layer, an inner liner, and an insulating layer, where at least a portion of the insulating layer is positioned between the bottom layer and the inner liner. The insulating device may also include a lid assembly rotatably connected to the body assembly, where the lid assembly includes an upper layer, a lid insulating layer, and a lid liner. The upper layer of the lid assembly may include perimeter edges that extend upward away from the body assembly, where the perimeter edges have an edge height defined as a vertical height from a top surface of the upper layer to a top of the perimeter edges, wherein the edge height is greater than a thickness of the lid insulating layer. A storage compartment may formed by the body assembly and the lid assembly, where the insulating device has an open configuration providing access to the storage compartment and a closed configuration. The insulating device may also include a closure selectively adapted to connect the body assembly and the lid assembly, where the closure is attached to the first sidewall with a connection element, where the connection element extends through the first sidewall, closure, the inner liner, and the insulating layer. An insulated tab may be formed from a portion of the inner liner and a portion of the insulating layer, where the insulated tab is arranged inward of the closure and has a distal end extending above a midpoint of the closure. The insulated tab may include a first magnetic element that engages a second magnetic element on the lid assembly when the insulating device is in the closed configuration. The insulated tab may be formed from the inner liner, where the inner liner forms an outward facing layer of the insulated tab and an inward facing surface of the insulated tab. The insulated tab may extend along an entire length of the closure to insulate the storage compartment along the entire length of the closure.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

Figure 1:
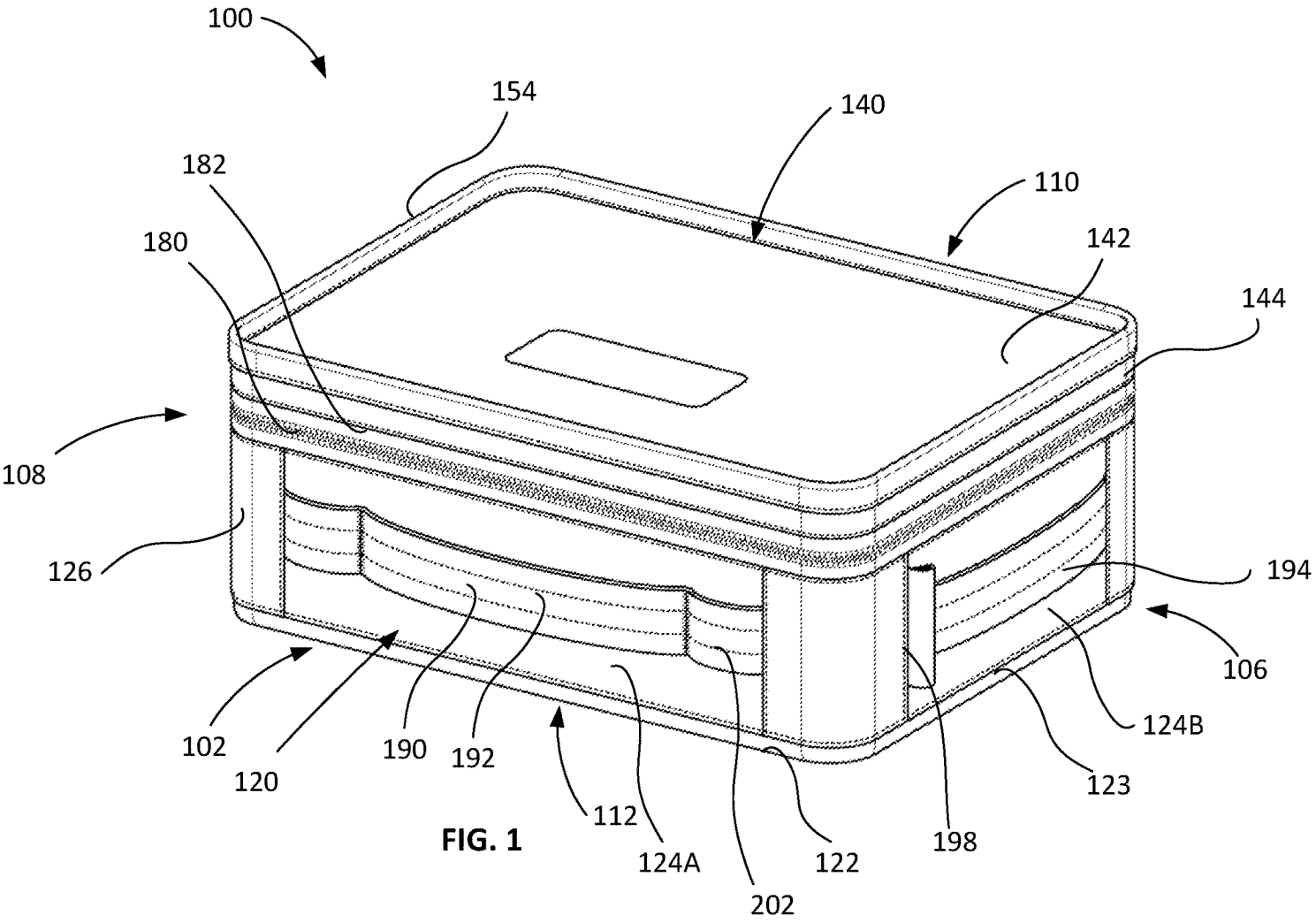
FIG. 1 illustrates a right front perspective view of an example insulating device in a closed configuration in accordance with an aspect of the disclosure.

In the following description of the various examples and components of this disclosure, reference is made to the accompanying drawings, which form a part hereof, and in which are shown by way of illustration various example structures and environments in which aspects of the disclosure may be practiced. It is to be understood that other structures and environments may be utilized and that structural and functional modifications may be made from the specifically described structures and methods without departing from the scope of the present disclosure.

Also, while the terms "front side," "rear side," "top," "bottom," "side," "inward," and "outward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims. In addition, the reader is advised that the drawings may not be to scale.

FIGS. 1-10 depict an exemplary insulating device 100 that can be configured to keep desired contents stored cool or warm for a desired period of time. In particular, illustrated embodiment of the insulating device 100 may be a soft-sided insulated lunchbox that may be used to keep the contents secure and at an appropriate storage temperature for at least several hours. The insulating device 100 may comprise a body assembly 120, a lid assembly 140 rotatably coupled to the body assembly 120, a storage compartment 160 formed by the body assembly 120 and the lid assembly 140, and a closure 180 adapted to selectively connect the body assembly 120 and the lid assembly 140. A plurality of handles 190 may be included on the insulating device 10 for carrying, holding, or securing the insulating device 100.

The insulating device 100 may be configured to keep desired contents stored in the storage compartment 160 cool or warm for several hours. In some embodiments, the insulating device 100 may also be designed to maintain water inside the storage compartment 160 and may be configured to be water "resistant" from the outside in. In these examples, the insulating device 100 may be "water tight" such that water cannot leak into storage compartment 160 from the outside or leak out from the storage compartment 160 when the closure 180 is in the closed position.

As shown in FIGS. 1-10, the insulating device 100 may be in the shape of a cuboid or rectangular prism and have a front side 102, a rear side 104, a right side 106, a left side 108, a top side 110, and a bottom side 112. For example, the body assembly 120 may comprise bottom layer 122, first sidewall 124A, second sidewall 124B, third sidewall 124C, and sidewall 124D, along with corner members 126 connecting the adjacent sidewalls 124A, 124B, 124C, 124D to form the exterior shape of the bottom portion of the cuboid. The lid assembly 140 may comprise an upper layer 142 and an upper sidewall 144 to form the exterior shape of the upper portion of the cuboid. Other shapes are also contemplated for the insulating device 100, for example, cylindrical, spherical, conical, pyramidal, frusto-conical, frusto-spherical, frusto-pyramidal, etc. The length of the insulating device 100 may be greater than the width and the height, and the width may be greater than the height. For example, the height of the insulating device 100 may, in one embodiment, be in the range of 80 mm to 150 mm, where in one particular example may be approximately 115 mm. The length of the insulating device 100 may be in the range of 200 mm to 310 mm, where in one particular example may be approximately 260 mm. Also, the width of the insulating device 100 may, in one example, be in the range of 150 mm to 270 mm and in one specific example, the width may be approximately 210 mm. However, it is contemplated that the insulating device 100 may comprise any height, length, width and volume dimensions, without departing from the scope of these disclosures.

The storage compartment 160 of the insulating device 100 may be accessed through the opening 162 formed at the top of the body assembly 120. An inner liner 128 of the body assembly 120 may form an interior surface of the storage compartment while a lid liner 146 may form the interior surface of the lid assembly 140. As will be discussed in more detail later, a lid insulating layer 148 may be positioned between the upper layer 142 and the lid liner 146, and an insulating layer 130 may be positioned between the sidewalls 124A, 124B, 124C, 124D and the inner liner 128 and/or also positioned between the bottom layer 122 and the inner liner 128.

The body assembly 120 may also include a plurality of handles 190. The handles 190 may be positioned on multiple sides of the body assembly 120. For instance, in the exemplary embodiment, the handles 190 may include a front handle 192 arranged on the front side 102, a right side handle 194 on the right side 106, and a left side handle 196 on the left side. The handles 190 may be attached using connection elements 198 such as stitching using threads, however these threads attaching the handles 190 may not, in some examples, extend into the insulating layer 130 or inner liner 128. The multiple handles 190 (192, 194, 196) provide a user with options for grasping for grasping and carrying the insulating device. In addition, a web loop 202 may be arranged on either end or both ends of the front handle 192 for attaching various items, (e.g., carabineers, storage cases, etc.). In some embodiments, the handles 190 and web loops 202 may be arranged anywhere on the body assembly 120 or the lid assembly 140. The handles 190 and web loops 202 may be constructed of nylon webbing. As alternate options, the handles 190 and web loops 202 may be formed from polypropylene, neoprene, polyester, Dyneema, Kevlar, cotton fabric, leather, plastics, rubber, or rope. The handles 190 and web loops 202 may be attached to the body assembly 120 by stitching, adhesive, or polymer welding. In some embodiments, the handles 190 and web loops 202 may be stitched to patches using threads, where the patches are then attached to the insulating device 100.

The insulating device 100 may also include pockets, tie downs, and D-rings anywhere on the external surface of the outer shell. The pockets can be sized for receiving keys, phones, wallets, etc. and may be formed waterproof. The pockets may also include a waterproof zipper to prevent the contents therein from getting wet.

Figure 9:
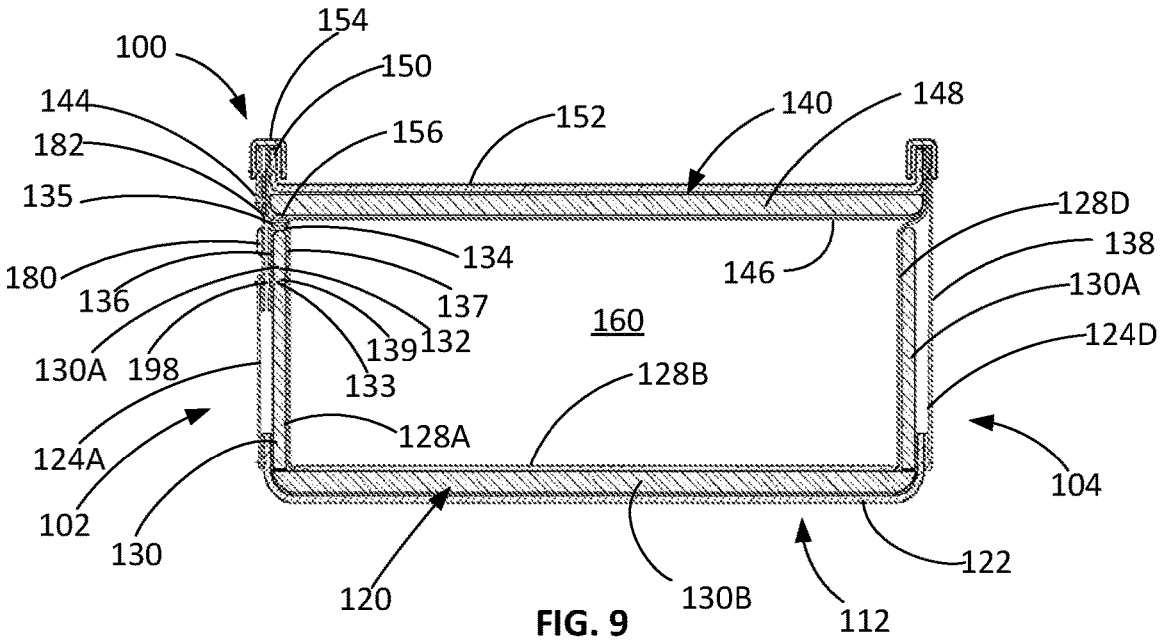
FIG. 9 illustrates a right side cross-sectional view as shown in FIG. 4.
Figure 10:
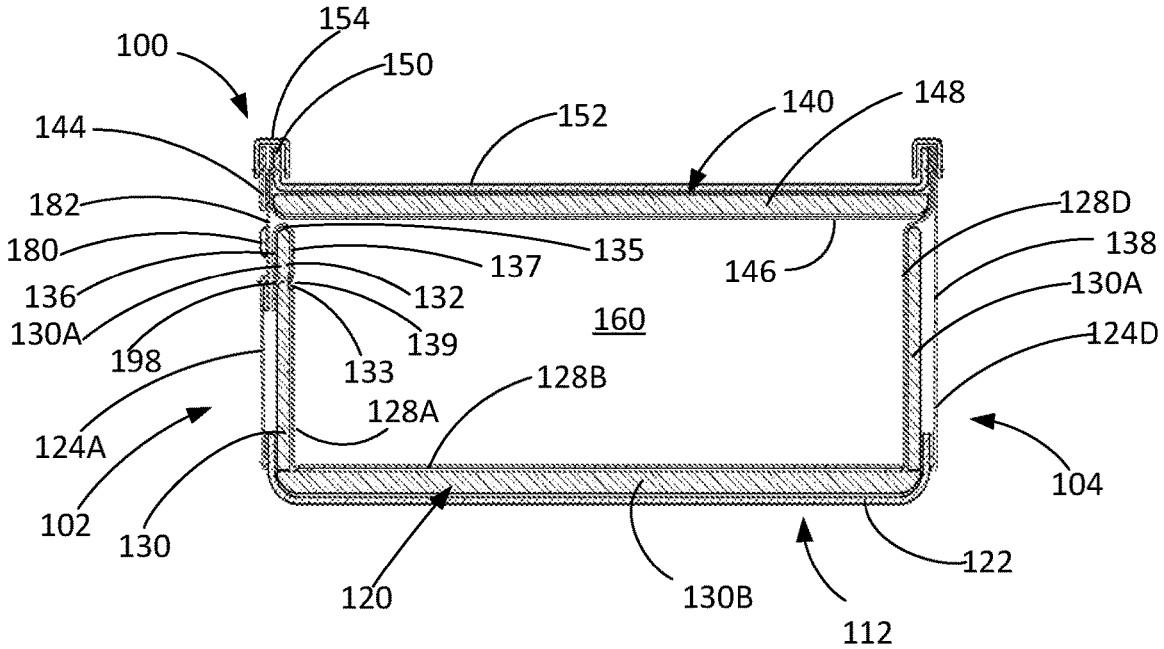
FIG. 10 illustrates a right side cross-sectional view as shown in FIG. 4.

As shown in the cross-sectional views of FIGS. 9 and 10, the body assembly 120 may comprise an inner liner 128 that encloses an insulating layer 130. For clarity, the handles 190 are removed from the cross-sectional views of FIGS. 9 and 10. In one example, as shown in FIG. 9, the inner liner 128 may be formed from one or more sidewall inner liners 128A and a bottom inner liner 128B. The one or more sidewall inner liners 128A may be secured together and to the bottom inner liner 128B with a lap joint using a polymer welding technique. Polymer welding may include both external and internal methods. External or thermal methods can include hot gas welding, hot wedge welding, hot plate welding, infrared welding and laser welding. Internal methods may include mechanical and electromagnetical welds. Mechanical methods may include spine welding, stir welding, vibration welding, and ultrasonic welding. Electromagnetical methods may include resistance, implant, electrofusion welding, induction welding, dielectric welding, RF (Radio Frequency) welding, and microwave welding. The welding can be conducted in a flat or horizontal plane to maximize the effectiveness of the polymer welding to the construction materials. Optionally, the liners 128A, 128B may be secured or joined together using a tape, such as a TPU tape can be placed over the seams to form the storage compartment 160.

The insulating layer 130 may be located between the inner liner 128 and the outer sidewalls 124A, 124B, 124C, 124D, and may be formed as an insulator to assist in maintaining the internal temperature of the storage compartment 160. In one example, the insulating layer 130 can be a free-floating layer that is not attached directly to the outer sidewalls or bottom layer 122. The insulating layer 130 may be formed as one or more sidewall insulating portions 130A and a bottom insulating portion 130B. The one or more sidewall insulating portions 130A and the bottom insulating portion 130B may be formed from an insulating foam material as will be described in further detail below. The one or more sidewall insulating portions 130A may be a closed cell foam and may have a thickness within a range of 2 mm and 6 mm, or approximately 4 mm. The bottom insulating layer 130B may be a closed cell foam and may have a thickness within a range between 4 mm and 8 mm, or approximately 6 mm. In one example, the insulating layer 130 may be formed of vinyl nitrate (NBR/PVC blend) or any other suitable blend.

Figure 2:
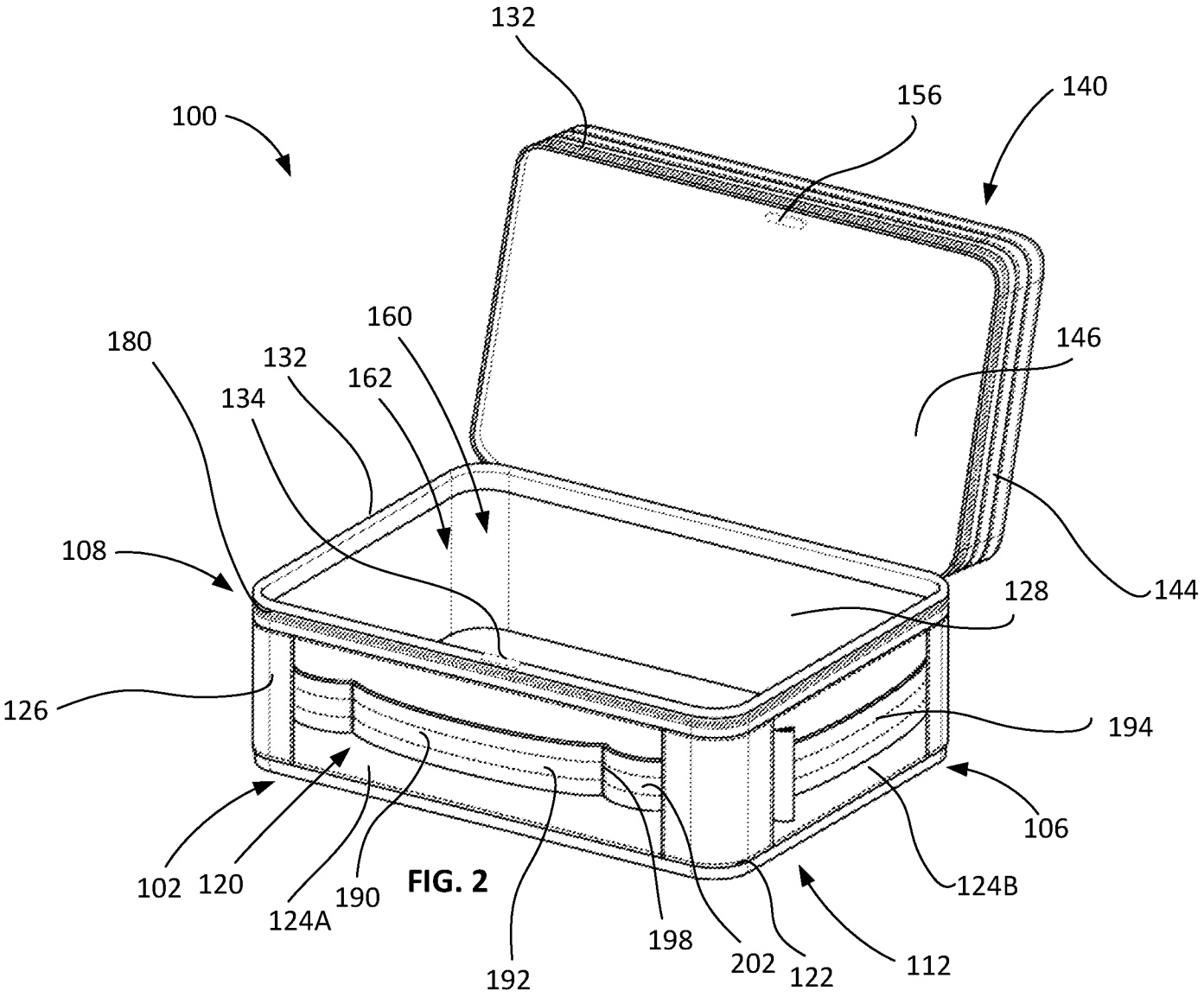
FIG. 2 illustrates a right front perspective view of the example insulating device of FIG. 1 in an open configuration.
Figure 4:
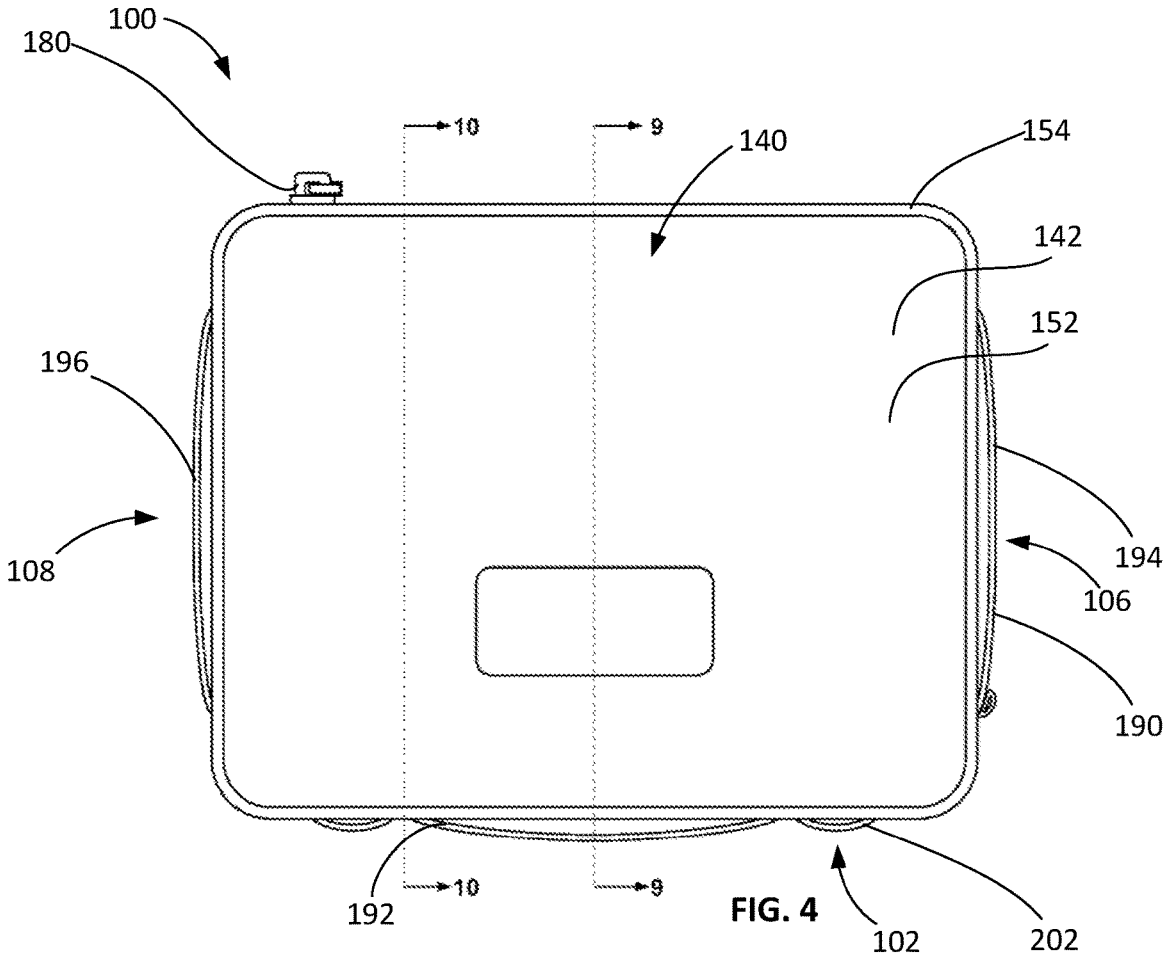
FIG. 4 illustrates a top view of the example insulating device of FIG. 1.
Figure 3:
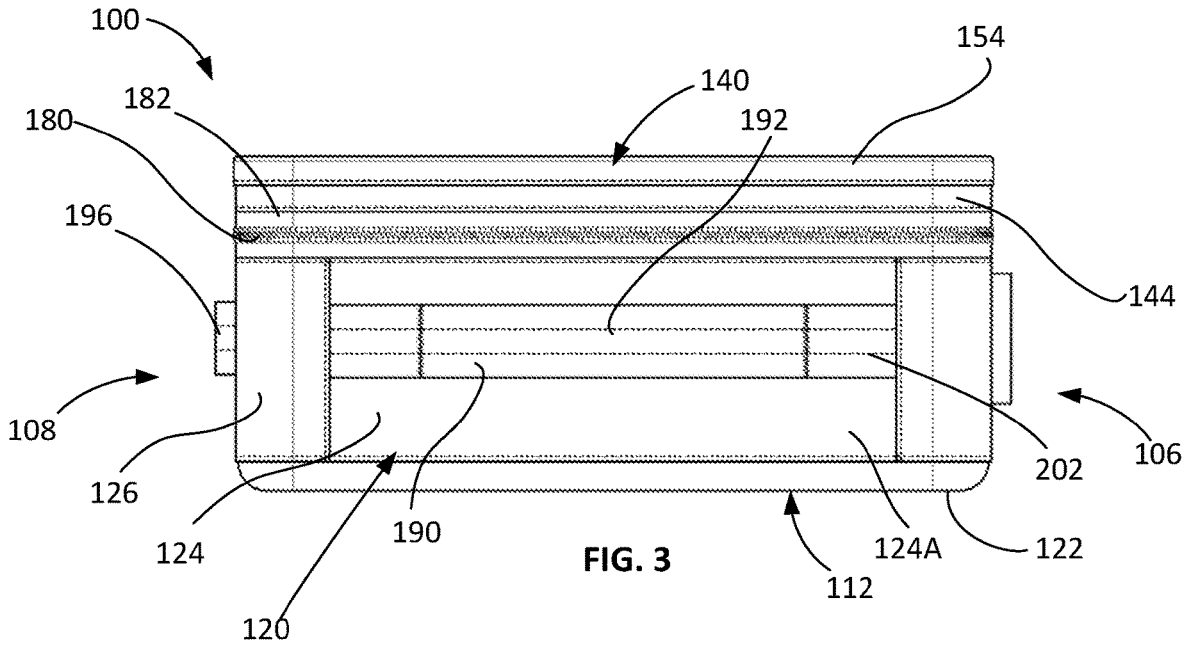
FIG. 3 illustrates a front view of the example insulating device of FIG. 1.
Figure 5:
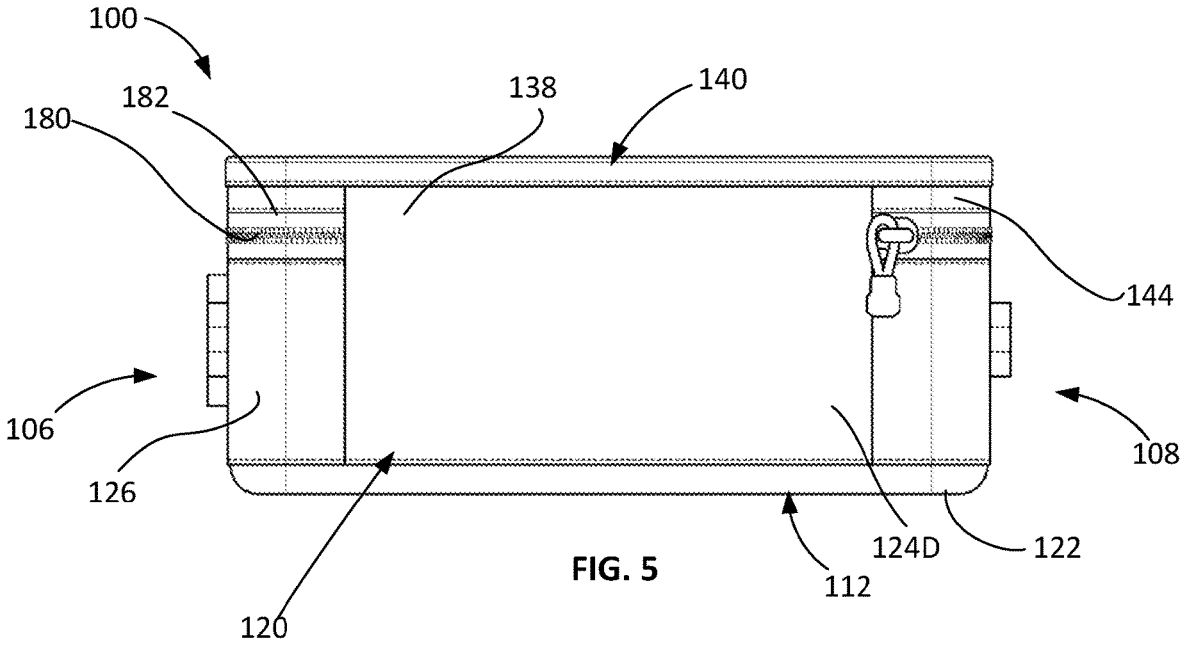
FIG. 5 illustrates a rear view of the example insulating device of FIG. 1.
Figure 6:
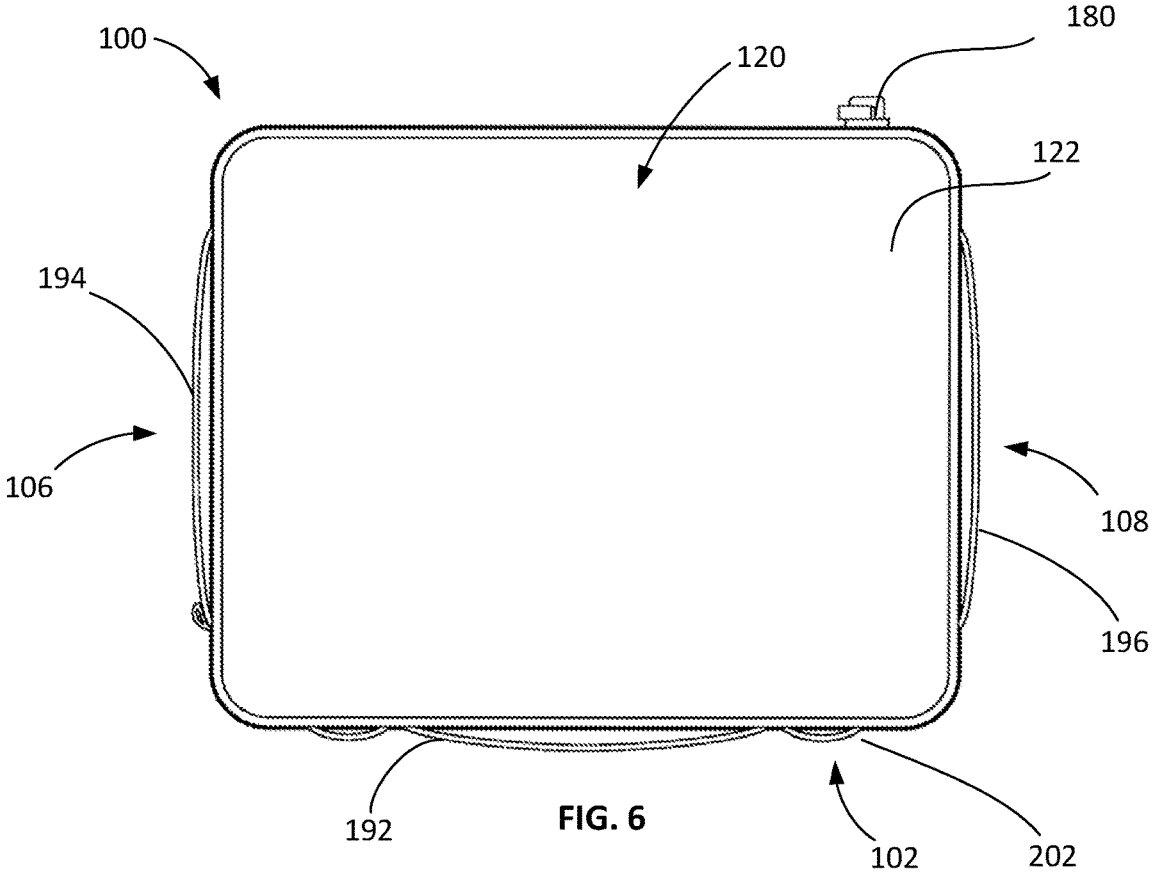
FIG. 6 illustrates a bottom view of the example insulating device of FIG. 1.
Figure 7:
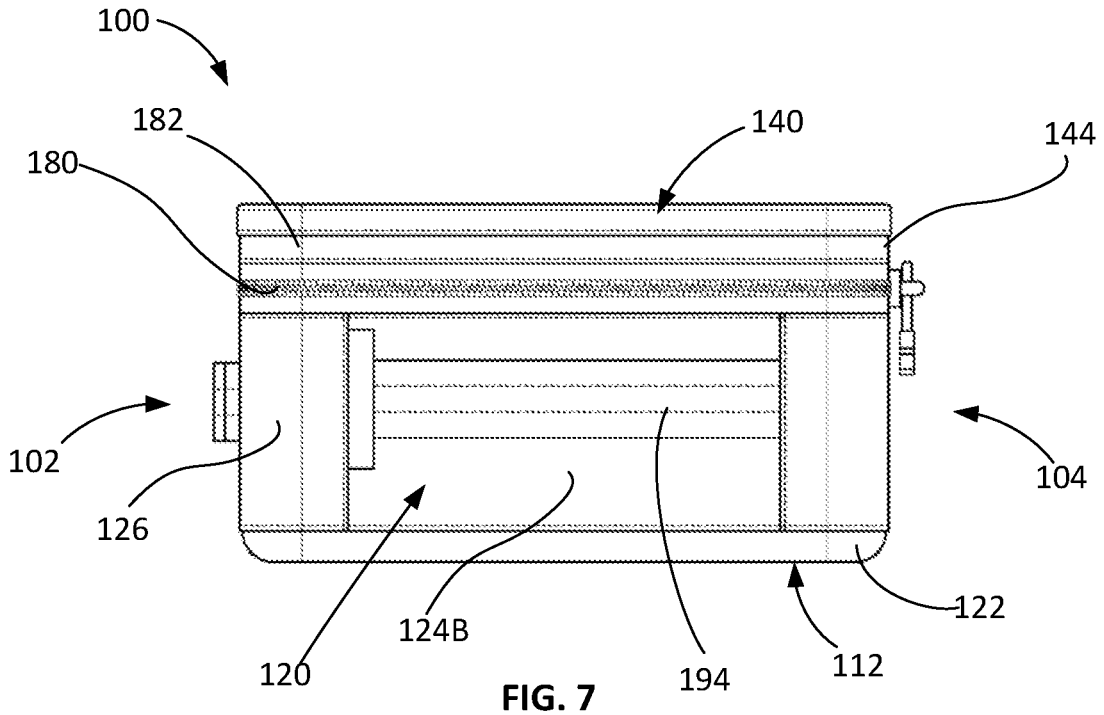
FIG. 7 illustrates a right side view of the example insulating device of FIG. 1.
Figure 8:
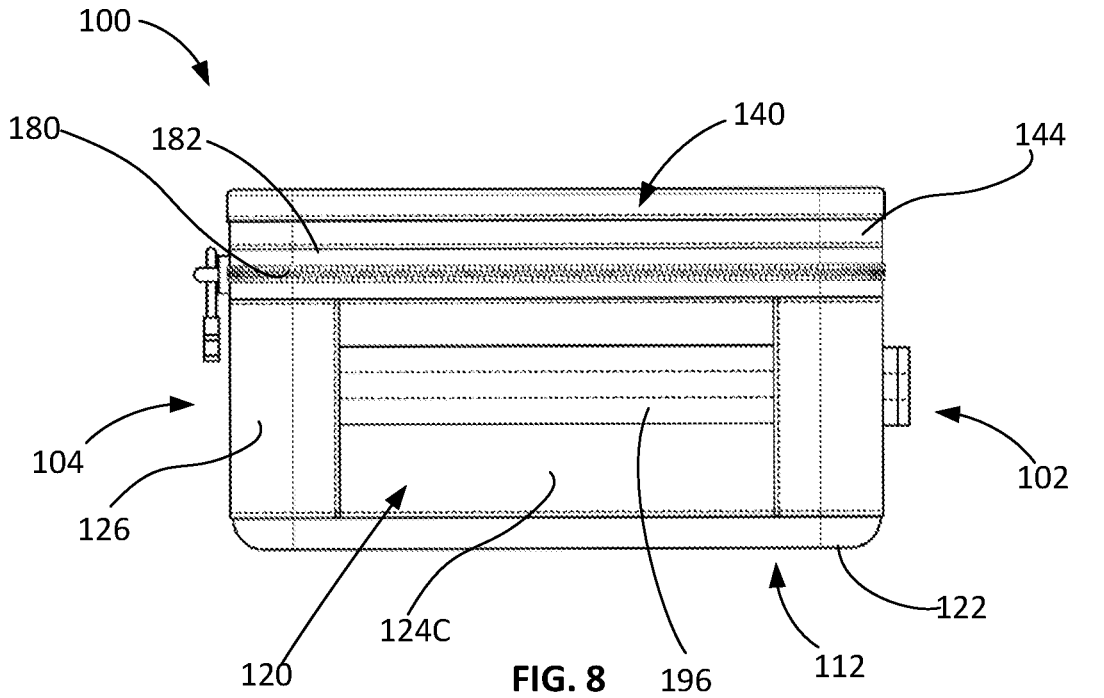
FIG. 8 illustrates a left side view of the example insulating device of FIG. 1.

In addition, an insulated tab 132 may be formed from a portion of the inner liner 128A and a portion of the sidewall insulating portions 130A to improve the overall insulating performance of the insulating device 100. As shown in FIGS. 2, 9, and 10, insulated tab 132 may be arranged inward or behind the closure 180 to provide a thermal retention member behind the closure 180. Insulated tab 132 may extend upward from a base end 133 at a connection region 139 where a lower end of the closure 180 is attached to one or more of the sidewalls 124A, 124B, 124C, 124D to a distal end 135 that may be positioned at or above a midpoint of the closure 180 in a vertical direction. The midpoint of the closure 180 being defined as the location where the closure 180 divides between a portion attached to the body assembly 120 and a portion attached to the lid assembly 140. In some instances, the distal end 135 of the insulated tab 132 may contact the lid liner 146 of the lid assembly 140 when the insulating device 100 is in the closed configuration. In some embodiments, the lid liner 146 and the insulated tab 132 may include complementary surfaces that form an interlocking feature to secure the insulated tab 132 to the lid liner 146 to improve the insulating performance of the insulating device 100. The interlocking feature may include a groove in the liner 146 that receives a top surface of the insulated tab 132. The insulated tab 132 may also extend continuously along a majority or along the entire length of the closure 180 to help insulate the storage compartment 160 along the length of the closure 180. In other words, the insulated tab 132 may extend continuously around the sides 106, 108, the front side 102, and a portion of the rear side 104 where insulated tab 132 may have ends that are adjacent to or connect to the hinge 138.

The insulated tab 132 may be formed from a portion the inner liner 128A and the sidewall insulating portion 130A, where the inner liner 128A may form an outward facing layer 136 and an inward facing layer 137 of the insulated tab 132. The inner liner 128 may extend around a portion of the sidewall insulating portion 130A from the outward facing layer 136 to the inward facing layer 137 and connect to the closure at a base end 133. As shown in FIGS. 9 and 10, the insulated tab 132 may be connected to the closure 180 along connection region 139 at the base end 133 via connection elements 198 that extend through the outward facing layer 136, the inward facing layer 137, the closure 180, one or more of the sidewalls 124A, 124B, 124C, 124D, and the sidewall insulating portion 130A when viewed in a cross-section formed by a vertical plane extending perpendicular to a bottom surface of the insulating device 100. In some embodiments, the insulated tab 132 may extend from the lid liner 146 where the base end is connected or formed from the lid liner 146 and has a distal end that may be positioned at or below a midpoint of the closure 180 in a vertical direction.

Alternatively, the insulated tab 132 may be formed as a separate component having a liner and a separate insulating layer that can be attached to the lid assembly 140 or attached to the body assembly 120. For instance, the separately formed insulated tab 132 may have a base end connected to the inner sidewall liner 128A and a distal end that may be positioned at or above a midpoint of the closure 180 in a vertical direction. As another option, the separately formed insulated tab 132 may have a base end connected to the lid liner 146 and a distal end that may be positioned at or below a midpoint of the closure 180 in a vertical direction. Still as another option, the separately formed insulated tab 132 may be attached to the closure 180 (such as attached backing or fabric 182) such that a first end of the insulated tab 132 may be attached on one side of the midpoint of the closure 180 and the insulated tab extends across the midpoint to the opposite side of the closure 180. Similar to the integrally formed insulated tab 132 described above, in the embodiments having a separately formed insulated tab 132, the tab 132 may also extend along a majority or along the entire length of the closure 180. The tab 132 may be attached at the ends to the hinge 138 and extend around the sides 106, 108, the front side 102, and a portion of the rear side 104, where insulated tab 132 may have ends that are adjacent to or connect to the hinge 138.

As discussed above, the body assembly 120 may comprise bottom layer 122, first sidewall 124A, second sidewall 124B, third sidewall 124C, and sidewall 124D, along with corner members 126 connecting the adjacent sidewalls 124 to form the exterior shape of the bottom portion of the cuboid. The sidewalls 124 and corner members 126 may be formed from multiple pieces and may be joined together with lap joints and secured together with connection elements 198 such as stitching, or attached using any known method, e.g., polymer welding, stitching, or other adhesive. The sidewalls 124 and corner members 126 may provide the exterior covering for the insulating device 100. As discussed above, the insulating layer 130 can be suspended freely within the body assembly 120. Alternatively, the insulating layer(s) 130 could also be secured or formed as a one-piece integral structure.

The bottom layer 122 may increase the insulation and the structural integrity of the insulating device 100. The bottom layer 122 may also provide additional protection around the bottom of the insulating device 100. The bottom layer 122 may have perimeter edges 123 that extend upward towards the lid assembly 140. In one example, the bottom layer 122 may be formed from EVA foam. The bottom layer 122 may also include a design such as a logo or name that can be molded or embossed directly into the material. The bottom layer 122 may be attached to the sidewalls 124A, 124B, 124C, 124D and corner members 126 by connection elements 198, such as stitching or other known methods.

The lid assembly 140 may include an upper layer 142, an upper sidewall 144, and a lid liner 146. The lid assembly 140 may be generally rectangular in shape and include perimeter edges 150 that extend upward away from the body assembly 120. These upward extending perimeter edges 150 may have a height that provides a user with a member that is easily gripped by a hand of the user to assist when opening and closing the closure 180. The perimeter edges 150 may have an edge height defined as a vertical height from a top surface 152 of the upper layer 142 to a top of the perimeter edges 150, where the edge height may be greater than a thickness of the lid insulating layer 148. In some embodiments, the edge height may be at least 2 times greater than the thickness of the lid insulating layer 148. The edge height may be approximately 18 mm, or within a range of 15 mm and 21 mm, or within a range of 12 mm and 24 mm. In other embodiments, the edge height may have an edge height of approximately 15 percent of a total height of the insulating device 100, or within a range of 13 percent and 17 percent of the total height of the insulating device 100, or within a range of 10 percent and 20 percent of the total height of the insulating device 100. The perimeter edges 150 may have a constant height of may have a variable height where a region of the perimeter edges is taller than an adjacent region. In some embodiments, the perimeter edges 150 may have an engaging or receiving member that could receive or secure accessories such as a bottle opener, or utensils. In addition, the upper layer 142 of the lid assembly 140 may have a pocket formed on the top surface, where the perimeter edges 150 may form a portion of the sides of the pocket where the pocket may be connected directly to the perimeter edges 150.

The upper sidewall 144 may be attached to the perimeter edges 150 around by a connection element like stitching. Optionally, the upper sidewall 144 may be attached to the perimeter edges 150 with an RF weld joint or other types of securing methods could be used such as other forms of welding, stitching, adhesives, rivets, etc. An edge member 154 may extend along an entire length of the perimeter edges 150 of the lid assembly 140 where the edge member 154 may be also attached to the upper layer 142 and upper sidewall 144 by connection elements 198, such as stitching or other means known to own skilled in the art.

The upper sidewalls 144 may be formed from multiple pieces and may be joined together with lap joints and secured together with connection elements 198 such as stitching, or attached using any known method, e.g., polymer welding, stitching, or other adhesive. The edge member 154 may be formed from a single nylon webbing piece or be formed from a plurality of webbing pieces. The insulating layer 148 may be suspended freely within the lid assembly 140 positioned between the upper layer 142 and the lid liner 146. Alternatively, the insulating layer(s) 148 could also be secured or formed as a one-piece integral structure. As another option, the lid liner 146 may be formed as a separate component and attached along the interior edges of the lid assembly 140. In addition, the lid liner 146 may further include a pocket or other retaining member, where the pocket may be configured to hold utensils, a portable ice pack, or other items.

The upper layer 142 may increase the insulation and the structural integrity of the insulating device 100. The upper layer 142 may also provide additional protection around the top of the insulating device 100. In one embodiment, the upper layer 142 may be formed from a foam rubber, such as ethylene-vinyl acetate (EVA) foam or similar material. The upper layer 142 may also include a design such as a logo or name that can be molded or embossed directly into the material.

The lid insulating layer 148 may be formed of a single layer of foam, which corresponds to the overall shape of the lid assembly 140. The foam may, in one example, be an insulating foam, as discussed herein, which may be the same foam as is used in the body assembly 120, and be unattached to and floating between the lid liner 146 and the upper sidewall 144.

In some embodiments, the liners 128, 146 may be constructed from double laminated TPU nylon fabric. The sidewalls 124A, 124B, 124C, 124D and upper sidewall 144 may be formed from a polyester fabric that is laminated with an ether TPU on Poly 600D Fabric Single Side Laminated Ether TPU on at least one side of the fabric. The laminated fabric forming the liners and sidewalls may be waterproof and have an antimicrobial additive or coating that meets all Food and Drug Administration requirements. In addition, the fabrics used to construct the insulating device may all have antimicrobial materials incorporated to create a mildew-free environment that is food contact surface safe. In one specific example, the nylon can be 840d nylon with TPU. Alternative materials used to manufacture the inner liner 128, lid liner 146, sidewalls 124A, 124B, 124C, 124D, and upper sidewall 144 may be PVC, TPU coated nylon, coated fabrics, and other weldable and waterproof fabrics.

Additionally, as shown the cross-sectional views of FIGS. 9 and 10, the lid assembly 140 may be connected to the body assembly 120 on one side of the insulating device 100, which forms a living hinge 138. In the exemplary embodiment, the living hinge 138 may be formed by the sidewall 124D on a rear side 104 of the insulating device 100. The sidewall 124D may have a greater height than the other sidewalls 124. The sidewall 124D may connect to the bottom layer 122 of the body assembly 120 and extend upward and connect to the upper layer 142 of the lid assembly. The living hinge 138 may also be reinforced by an inner piece of fabric material. In some embodiments, a portion of the inner liner 128D may reinforce the living hinge 138, such that the inner liner 128D may extend upward from the storage compartment 160 and attach to the upper layer 142 between the upper layer 142 and the sidewall 124D. By using the living hinge 138, the storage compartment 160 may and its contents may be accessed by opening the closure 180 and rotating or folding back the lid assembly 140 along the living hinge 138.

As discussed above, the closure 180 may be selectively connected to the body assembly 120 and the lid assembly 140. The closure 180 may be attached to the sidewalls 124A, 124B, 124C, 124D using connection elements 198, where the connection elements 198 may be stitching with threads. In particular, the closure 180 may be attached to at least one of the sidewalls 124A, 124B, 124C, 124D with connection elements 198, where the connection elements 198 extend through one or more of the sidewalls 124A, 124B, 124C, 124D, the closure 180, the inner liner 128, and the insulating layer 130 when viewed in a cross-section formed by a vertical plane extending perpendicular to a bottom surface of the insulating device as shown in FIGS. 9 and 10. Similarly, along the corners of the insulating device 100, the closure 180 may be attached to at least one of the corner members 126 with connection elements 198, where the connection elements 198 extend through a corner member 126, the closure 180, the inner liner 128, and the insulating layer 130. The closure 180 may be opened to allow access to the storage compartment 160 or closed to prevent access to the storage compartment 160. The closure 180 may be a zipper assembly as shown in FIGS. 1-10, but may be other sealing devices. For example, the closure 180 may be a hook and loop type fastener (i.e. Velcro), snaps, buckles, excess material that is folded multiple times to form a seal such as a roll-down seal, seals, metal or plastic clamps and combinations thereof could be used as a closure mechanism.

The closure 180 may extend around the entire perimeter or a majority of the perimeter of the insulating device 100, such as at least three sides of the insulating device 100. In this particular example, the contents of the insulating device 100 may be easily accessed by the user after the closure 180 is opened and the lid assembly 140 is rotated away from the body assembly 120 along hinge 138 as shown in FIG. 2.

The closure 180 may be mounted on a backing or fabric 182, which is included as a portion of the closure 180 as described herein. In the case of the closure being a zipper, this can be referred to as zipper tape 182. The zipper tape 182 may be attached between each sidewall 124A, 124B, 124C, 124D and the inner liner 128 on the body assembly 120 and may be attached between the upper sidewall 144 and the lid liner 146 on the lid assembly 140. In addition, as described above, where the connection element 198 extends through the closure 180 may be interpreted as the connection element extending through the fabric or zipper tape 182.

As discussed above, the storage compartment may include an insulated tab 132 that extends along the length of the closure 180, where the insulated tab 132 also extends upward beyond the midpoint of the closure 180. In some embodiments, the insulated tab 132 may include a magnetic element 134 secured within the insulated tab 132. The magnetic element 134 may be positioned along an upper region of the tab 132 such that the magnetic element 134 may engage a magnetic element 156 that is secured within the lid assembly 140. The attractive forces of the magnetic elements 134 and 156 may cause the lid liner 146 to contact the portion of the inner liner 128 forming the exterior surface of the insulated tab 132 when the insulating device is in its closed configuration. In addition, the magnetic forces may help keep the insulated tab 132 elevated an in its proper position when the insulating device 100 is in its closed configuration, thereby helping to further minimize any temperature increase or decrease within the storage compartment. Magnetic element 134 may be secured within the insulated tab 132 between the inner liner 128 and the sidewall insulating portion 130A. Similarly, magnetic element 156 may be positioned between the lid liner 146 and the lid insulating layer 148. In some embodiments, the magnetic elements 134, 156 may be secured under the respective liners 128, 146 such that they are not visible when the insulating device 100 is in its open configuration, while in other embodiments, the magnetic elements 134, 156 may be positioned in pockets or bosses (not shown) in the insulated tab 132 and lid liner 146 that protrude above the surface of the insulated tab 132 and lid liner 146. The magnetic elements 134, 156 may be secured in place using an adhesive, welding, or other technique known to one skilled in the art.

The magnetic elements 134, 156 may have their center points substantially aligned with each other to maximize their attractive force to one another. Additionally, in some embodiments the insulating device may comprise one pair of magnetic elements positioned along a center plane of the front side 102 of the insulating device 100. In other embodiments, the insulating device may include multiple pairs of magnetic elements positioned along the length of the insulated tab 132 and in corresponding positions on the lid assembly 140.

The magnetic elements 134, 156 may have any shape and size, and in some instances each magnetic element 134, 156 may be the same size, while in other embodiments, the magnetic elements may have different sizes. For example, in the exemplary embodiment, the magnetic elements 134, 156 may have a rectangular shape with a length of approximately 25 mm, a width of approximately 5 mm and a thickness of approximately 2 mm. The magnetic elements 134, 156 may be one or more of permanent magnets, metal strips, or ferromagnetic materials.

The present invention is disclosed above and in the accompanying drawings with reference to a variety of examples. The purpose served by the disclosure, however, is to provide examples of the various features and concepts related to the invention, not to limit the scope of the invention. One skilled in the relevant art will recognize that numerous variations and modifications may be made to the examples described above without departing from the scope of the present invention.

What is claimed is:

1. A soft-sided lunchbox comprising:

a body assembly, wherein the body assembly includes an inner liner;

a lid assembly rotatably connected to the body assembly, wherein the lid assembly is rectangular in shape;

a storage compartment formed by the body assembly and the lid assembly, wherein the soft-sided lunchbox has an open configuration providing access to the storage compartment and a closed configuration preventing access to the storage compartment;

a closure positioned between the body assembly and the lid assembly, wherein the closure is adapted to selectively connect the body assembly and the lid assembly; and a tab formed from a portion of the inner liner, wherein the tab is within the storage compartment; and wherein the tab includes a first magnetic element that engages a second magnetic element on the lid assembly when the soft-sided lunchbox is in the closed configuration.

2. The soft-sided lunchbox of claim 1, wherein the lid assembly includes perimeter edges that extend upward away from the body assembly.

3. The soft-sided lunchbox of claim 2, wherein the perimeter edges have an edge height defined as a vertical height from a top surface of the perimeter edges to a top surface of an upper layer of the lid assembly, wherein the edge height is within a range of 15 mm and 21 mm.

4. The soft-sided lunchbox of claim 3, wherein the edge height is within 13 percent and 17 percent of a total height of the soft-sided lunchbox.

5. The soft-sided lunchbox of claim 2, wherein the tab is an insulated tab that extends along a length of the closure to insulate the storage compartment along the length of the closure.

6. The soft-sided lunchbox of claim 2, wherein the closure is a zipper.

7. The soft-sided lunchbox of claim 1, wherein the inner liner forms an outward facing layer of the tab and an inward facing layer of the tab.

8. The soft-sided lunchbox of claim 7, wherein the inner liner extends around a sidewall insulating portion from the inward facing layer to the outward facing layer, wherein the tab is connected to the closure at a base end.

9. The soft-sided lunchbox of claim 8, wherein the tab is connected to the closure at the base end via a connection element that extends through the inward facing layer, the outward facing layer, and the closure when viewed in a cross-section formed by a vertical plane extending perpendicular to a bottom surface of the soft-sided lunchbox.

10. A soft-sided lunchbox comprising:

a body assembly, wherein the body assembly includes a bottom layer, a first sidewall attached to the bottom layer, a second sidewall adjacent the first sidewall, a third sidewall opposite the second sidewall, and an inner liner;

a lid assembly rotatably connected to the body assembly, wherein the lid assembly is rectangular in shape;

a storage compartment formed by the body assembly and the lid assembly, wherein the soft-sided lunchbox has an open configuration providing access to the storage compartment and a closed configuration preventing access to the storage compartment;

a closure adapted to selectively connect the body assembly and the lid assembly;

an insulated tab formed from a portion of the inner liner;

a first handle positioned on the first sidewall, wherein the first handle with a first web loop arranged at a first end of the first handle and a second web loop arranged at a second end of the first handle;

a second handle positioned on the second sidewall; and wherein the insulated tab includes a first magnetic element that engages a second magnetic element on the lid assembly when the soft-sided lunchbox is in the closed configuration.

11. The soft-sided lunchbox of claim 10, further comprising a third handle positioned on the third sidewall.

12. The soft-sided lunchbox of claim 11, wherein the first handle, the second handle, the third handle, the first web loop, and the second web loop are formed of nylon webbing.

13. The soft-sided lunchbox of claim 10, wherein the insulated tab is formed from the inner liner, wherein the inner liner forms an outward facing layer of the insulated tab and an inward facing surface of the insulated tab.

14. The soft-sided lunchbox of claim 10, wherein the insulated tab extends along an entire length of the closure to insulate the storage compartment along the entire length of the closure.

15. A soft-sided lunchbox comprising:

a body assembly, wherein the body assembly includes a bottom layer, a first sidewall attached to the bottom layer, an inner liner, and a sidewall insulating portion, wherein at least a portion of the sidewall insulating portion is positioned between the first sidewall and the inner liner;

a lid assembly rotatably connected to the body assembly; wherein the lid assembly includes an upper layer, a lid insulating layer, and a lid liner;

a storage compartment formed by the body assembly and the lid assembly, wherein soft-sided lunchbox has an open configuration providing access to the storage compartment and a closed configuration preventing access to the storage compartment;

a closure adapted to selectively connect the body assembly and the lid assembly; and a tab that is located within the storage compartment and inward of the closure; and a first handle positioned on the first sidewall, wherein the first handle with a first web loop arranged at a first end of the first handle and a second web loop arranged at a second end of the first handle; and wherein the tab includes a first magnetic element that engages a second magnetic element on the lid assembly when the soft-sided lunchbox is in the closed configuration.

16. The soft-sided lunchbox of claim 15, wherein the tab contacts the lid liner on the lid assembly when the soft-sided lunchbox is in the closed configuration.

17. The soft-sided lunchbox of claim 15, wherein the first magnetic element and the second magnetic element are positioned along a center plane of the soft-sided lunchbox.

18. The soft-sided lunchbox of claim 15, wherein the soft-sided lunchbox has a shape of a rectangular prism.

* * * * *